US005560060A

United States Patent [19]

Dausch et al.

[11] Patent Number: 5,560,060

[45] Date of Patent: Oct. 1, 1996

[54] SYSTEM AND METHOD FOR ADJUSTING THE OPERATING CYCLE OF A CLEANING APPLIANCE

[75] Inventors: Mark E. Dausch, Latham, N.Y.; Roger L. Hoffman, Louisville, Ky.; Gregory O. Miller, Louisville, Ky.; David A. Schneider, Louisville, Ky.; Vivek V. Badami, Schenectady, N.Y.

[73] Assignee: General Electric Company, Schenectady, N.Y.

[21] Appl. No.: 370,752

[22] Filed: Jan. 10, 1995

[51] Int. Cl.[6] ..... D06F 33/02; A47L 15/46

[52] U.S. Cl. ..... 8/158; 8/159; 68/12.02; 68/12.03; 68/12.12; 68/12.22; 68/12.27; 134/18; 134/25.2; 134/57 D

[58] Field of Search ..... 134/56 D, 57 D, 134/58 D, 18, 25.2; 68/12.01, 12.02, 12.03, 12.27, 12.12, 12.21, 12.22; 8/158, 159

[56] References Cited

U.S. PATENT DOCUMENTS

| | | | |
|---|---|---|---|
| 3,870,417 | 3/1975 | Bashark . | |
| 3,888,269 | 6/1975 | Bashark . | |
| 4,222,250 | 9/1980 | Torita . | |
| 5,172,572 | 1/1992 | Ono . | |
| 5,265,446 | 11/1993 | Kuroda et al. . | |
| 5,272,892 | 12/1993 | Janutka et al. | 68/12.22 X |
| 5,284,523 | 2/1994 | Badami et al. . | |
| 5,291,626 | 3/1994 | Molnar et al. . | |
| 5,330,580 | 7/1994 | Whipple, III et al. . | |
| 5,411,042 | 5/1995 | Suzuki et al. | 68/12.02 X |
| 5,444,531 | 8/1995 | Foreman et al. | 68/12.27 X |

*Primary Examiner*—Philip R. Coe

*Attorney, Agent, or Firm*—David C. Goldman; Marvin Snyder

[57] ABSTRACT

A system and method for adjusting the operating cycle of a cleaning appliance. In the present invention, a controller having a decision system receives turbidity and temperature measurements from a turbidity sensor and a temperature sensor and uses these measurements to adjust the operating cycle of the machine to the level of soil of the articles to be washed, the rate of soil removal, and the temperature of the water used for washing. In its preferred form the decision system is a fuzzy system that includes a fuzzy rule base fired as input values from the liquid temperature and liquid turbidity sensors are received. The decision system matches the rules in the fuzzy rule base to the input values and outputs a confidence value, which is used by the decision system to adjust the operating cycle.

30 Claims, 22 Drawing Sheets

| | | | | CV (Confidence Value) |
|---|---|---|---|---|
| Turbidity | VL | dTurbidity | NEG | VH |
| | | | ZERO | HIGH |
| | | | POS | MED |
| | LOW | dTurbidity | NEG | HIGH |
| | | | ZERO | MED |
| | | | POS | LOW |
| | MED | dTurbidity | NEG | LOW |
| | | | ZERO | VL |
| | | | POS | VL |
| | HIGH | dTurbidity | NEG | VL |
| | | | ZERO | VL |
| | | | POS | VL |

| | | CV (Confidence Value) | Rule Weight |
|---|---|---|---|
| Temperature | LOW | VL | 1.50 |
| | MED | MED | .25 |
| | HIGH | HIGH | .25 |

FIG. 5a NORMAL WASH MATRIX

| | | ORIGINAL PARAMETERS | | | | | | | MAIN WASH MODIFIERS | | | | |
|---|---|---|---|---|---|---|---|---|---|---|---|---|---|
| Fill Num. | Fill Cycle Name | Fill Time Sec. | Gal. | Circ Time Min. | Max Temp °F | Xtend Time Min | Drain Pump | D-Trip | # Fills | Fill Time Sec | Circ Time Min. | Max Temp °F | Xtend Time Min |
| 1 | Pre Wash 1 | 80 | 1.67 | 5 | 120 | 0 | 1 | 0 | 4 | 90 | 12 | 125 | 15 |
| 2 | Pre Wash 2 | 80 | 1.67 | 5 | 120 | 0 | 1 | 0 | 5 | 90 | 15 | 130 | 15 |
| 3 | Main Wash | 90 | 1.88 | 22 | 135 | 15 | 0 | 1 | | 0 | 0 | 0 | 0 |
| 4 | Rinse 1 | 56 | 1.17 | 2 | 0 | 0 | 0 | 0 | | 0 | 0 | 0 | 0 |
| 5 | Rinse 2 | 70 | 1.46 | 3 | 0 | 0 | 0 | 0 | | 0 | 0 | 0 | 0 |
| 6 | Final Rinse | 70 | 1.46 | 5 | 125 | 0 | 0 | 1 | | 0 | 0 | 0 | 0 |

FIG. 5b POTSCRUBBER WASH MATRIX

| | | ORIGINAL PARAMETERS | | | | | | | MAIN WASH MODIFIERS | | | | |
|---|---|---|---|---|---|---|---|---|---|---|---|---|---|
| Fill Num. | Fill Cycle Name | Fill Time Sec. | Gal. | Circ Time Min. | Max Temp °F | Xtend Time Min | Drain Pump | D-Trip | # Fills | Fill Time Sec | Circ Time Min. | Max Temp °F | Xtend Time Min |
| 1 | Pre Wash 1 | 80 | 1.67 | 5 | 110 | 0 | 1 | 0 | | 90 | - | - | - |
| 2 | Pre Wash 2 | 80 | 1.67 | 5 | 120 | 0 | 1 | 0 | 5 | 90 | 15 | 130 | 15 |
| 3 | Pre Wash 3 | 70 | 1.46 | 2 | 125 | 0 | 1 | 0 | 6 | 90 | 22 | 135 | 15 |
| 4 | Pre Wash 4 | 70 | 1.46 | 2 | 130 | 0 | 1 | 0 | 7 | 0 | 22 | 135 | 15 |
| 5 | Main Wash | 90 | 1.88 | 22 | 135 | 15 | 0 | 1 | | 0 | 0 | 0 | 0 |
| 6 | Rinse 1 | 56 | 1.17 | 2 | 0 | 0 | 0 | 0 | | 0 | 0 | 0 | 0 |
| 7 | Rinse 2 | 70 | 1.46 | 2 | 0 | 0 | 0 | 0 | | 0 | 0 | 0 | 0 |
| 8 | Final Rinse | 70 | 1.46 | 5 | 125 | 0 | 0 | 1 | | 0 | 0 | 0 | 0 |

| Turbidity | | dTurbidity | CV (Confidence Value) |
|---|---|---|---|
| | VL | NEG | VH |
| | | ZERO | HIGH |
| | | POS | MED |
| | LOW | NEG | HIGH |
| | | ZERO | MED |
| | | POS | LOW |
| | MED | NEG | LOW |
| | | ZERO | VL |
| | | POS | VL |
| | HIGH | NEG | VL |
| | | ZERO | VL |
| | | POS | VL |

| Temperature | CV (Confidence Value) | Rule Weight |
|---|---|---|
| LOW | VL | 1.50 |
| MED | MED | .25 |
| HIGH | HIGH | .25 |

FIG. 9

SYSTEM AND METHOD FOR ADJUSTING THE OPERATING CYCLE OF A CLEANING APPLIANCE

CROSS REFERENCE TO RELATED APPLICATION

This application is related to commonly assigned, co-pending U.S. patent application Ser. No. 08/370,795 [Attorney docket No. 9D-DW-18700] by Smith, et al. entitled "Dishwasher With Turbidity Sensing Mechanism", filed on the same date.

BACKGROUND OF THE INVENTION

The present invention relates generally to an appliance for cleaning articles, and more particularly to an appliance having a decision system that uses turbidity and temperature measurements to adjust the washing cycle of the appliance according to the level of soft of the articles to be washed, the rate of soil removal, and the temperature of the water used for washing.

Reducing the amount of energy consumption in appliances such as dishwashers or clothes washers, is a significant problem, in part because a large amount of energy is needed to heat incoming water. For example, dishwashers use energy from two distinct sources. One source is the water-heating energy (WHE) consumed by the hot water heater that supplies hot water to the dishwasher. The second source is the electrical energy used to run the dishwasher pump and a resistance heating element enclosed in the dishwasher. The resistance heating element boosts the water temperature during wash and dries the dishes after they are clean.

The Department of Energy (DOE) requires manufacturers to measure the mechanical energy consumed by the motor and heating element with a kilowatt-hour meter and the quantity of water used with a flow meter and timer. The total energy consumption per cycle is defined as $$E=WHE+M, \quad (1)$$

where WHE is the water heating energy used by the hot water heater to supply hot water to the dishwasher and M is the mechanical energy consumed by the motor and heating element, that is measured with the kilowatt-hour meter. Incoming 120 F. hot water is assumed to be provided from a 50 F. cold source with a constant volumetric specific heat (Cv) of $$Cv=0.00240\ kwh/gal\text{-}F. \quad (2)$$

The "Normal" cycle of a typical dishwasher uses a volume (V) of water for an entire cycle of $$V=9\ \text{gallons}. \quad (3)$$

The equation for Water Heating Energy (WHE) is $$WHE=V\ Cv(T2-T1), \quad (4)$$

where $T_2$ is the temperature of the heated water and $T_1$ is the temperature of the water from the cold source.

Therefore, the WHE for one cycle is $$9\ gal\times 0.0024\ kwh/gal\text{-}F\times 70F=1.512\ kwh \quad (5)$$

of water heating energy. The average mechanical energy consumption per cycle runs about 0.65 kwh. From Equation 1, the average total energy consumption for a "Normal" cycle is 2.16 kwh. Therefore, reducing the water heating energy by reducing the water consumption has a major impact on the overall energy consumption of the dishwasher.

Previous attempts to increase efficiency have ignored the preparation or condition of dishes going into the dishwasher. For example, a person using a conventional dishwasher may rinse the dishes before they are washed if there is any uncertainty whether the dishwasher will completely remove all the soils from the dishes. If the person uses 10 gallons of hot water to rinse the dishes and then runs an "efficient" 9 gallon cycle, then the same 9 gallon cycle is run whether the dishes are pre-rinsed by the user or not. An adaptive dishwasher responds to the heavy load soil if not pre-rinsed with the 9 gallons or possibly less. However, if the person using the adaptive dishwasher cleans the dishes before loading the dishwasher, the adaptive dishwasher will detect dishes that have been pre-rinsed and use a modified 6 gallon cycle lowering total water consumption to 16 gallons. However, the conventional dishwashers do not efficiently adjust the washing cycle to match a user's habits. Thus, water usage and wash time are not fully optimized.

SUMMARY OF THE INVENTION

Therefore, it is a primary objective of the present invention to provide a washing appliance with an adaptive control system that optimizes water usage, wash time, and energy consumption.

Another objective of the present invention is to provide such a washing appliance with a control system that uses turbidity and temperature measurements to adjust the operating cycles of the appliance to the level of soil of the articles to be washed, the rate of soil removal, and the temperature of the water used for washing.

Thus, in accordance with the present invention, there is provided a washing appliance for cleansing soiled articles. The appliance comprises a container for receiving the soiled articles. A circulation pump distributes a liquid to the container. A temperature sensor senses the liquid temperature. A turbidity sensor senses the liquid turbidity. A controller, responsive to the temperature and turbidity sensors, adjusts the operating cycle as a function of the liquid temperature and the liquid turbidity.

While the present invention will hereinafter be described in connection with a preferred embodiment and a system and method of use, it will be understood that it is not intended to limit the invention to this embodiment. Instead, it is intended to cover all alternatives, modifications and equivalents as may be included within the spirit and scope of the present invention as defined by the appended claims.

BRIEF DESCRIPTION OF THE DRAWING

FIGS. 5A–5B are parameter tables used for a Normal Wash and a Potscrubber Wash operating cycle, respectively;

FIG. 9 shows rule tables used by the controller of FIG. 7;

DETAILED DESCRIPTION OF THE PRESENT INVENTION

Figure 1:
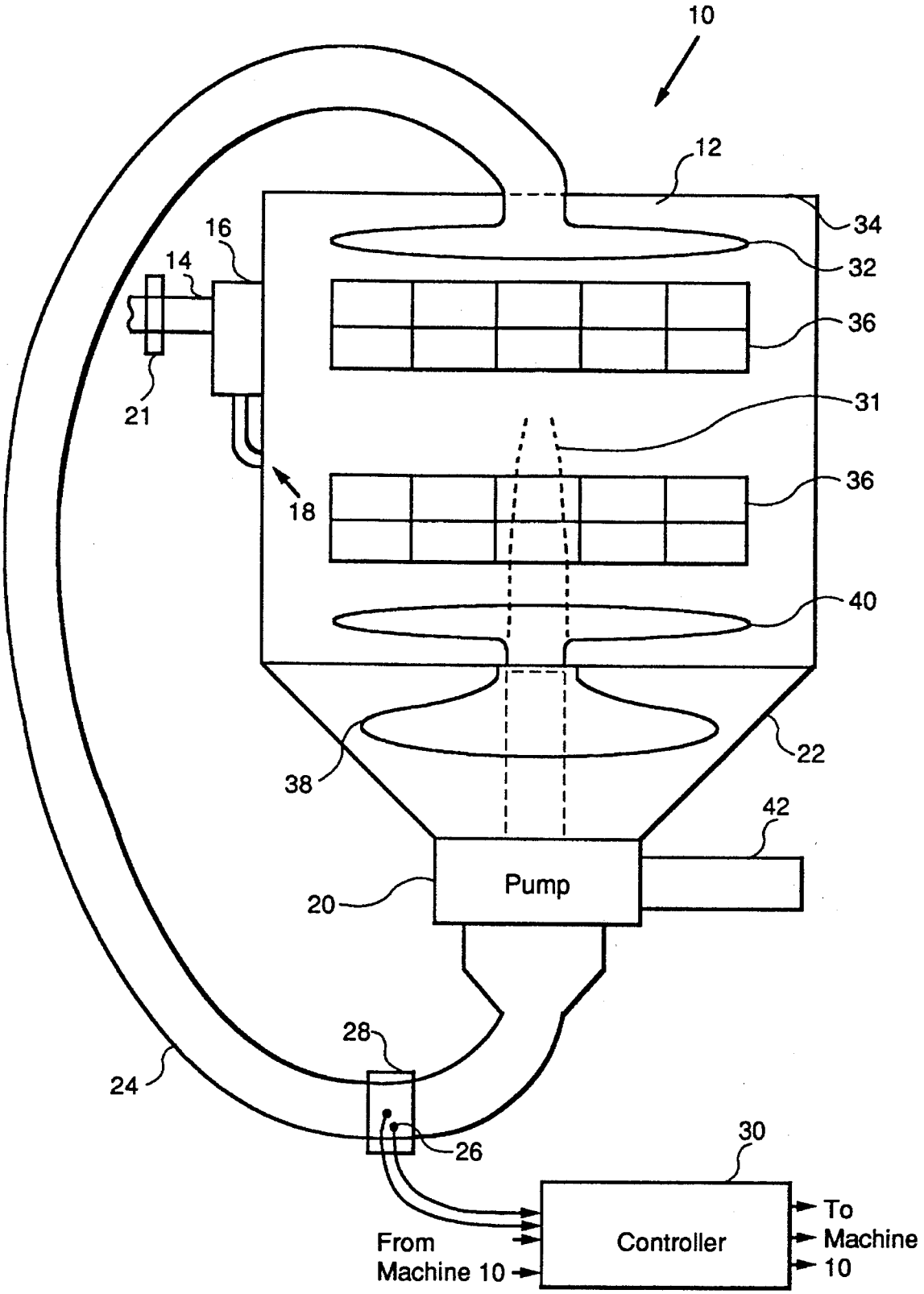
FIG. 1 is a schematic diagram of a dishwasher embodying the present invention.

FIG. 1 is a schematic of an appliance 10 for cleaning or washing articles in accordance with the present invention. In the preferred embodiment of the present invention, the appliance is described as a dishwasher but may also be a washing machine. The appliance 10 includes a container 12 for containing articles during a washing. Clean water is sent to the container via a valve 21, a conduit 14, a fill funnel 16, and an aperture 18. The water is distributed and recirculated by a pump 20. In particular, water from a sump 22 is distributed from the pump 20 via a recirculation hose 24. A turbidity sensor 26 and a temperature sensor 28 mounted within the recirculation hose 24 measure the turbidity in the recirculation hose and the temperature of the water in the recirculation hose, respectively. Although the turbidity sensor 26 is shown in FIG. 1 as being attached to the recirculation hose 24, this sensor should not be limited to this location and can also be located at other locations such as the container or the pump.

Figure 2:
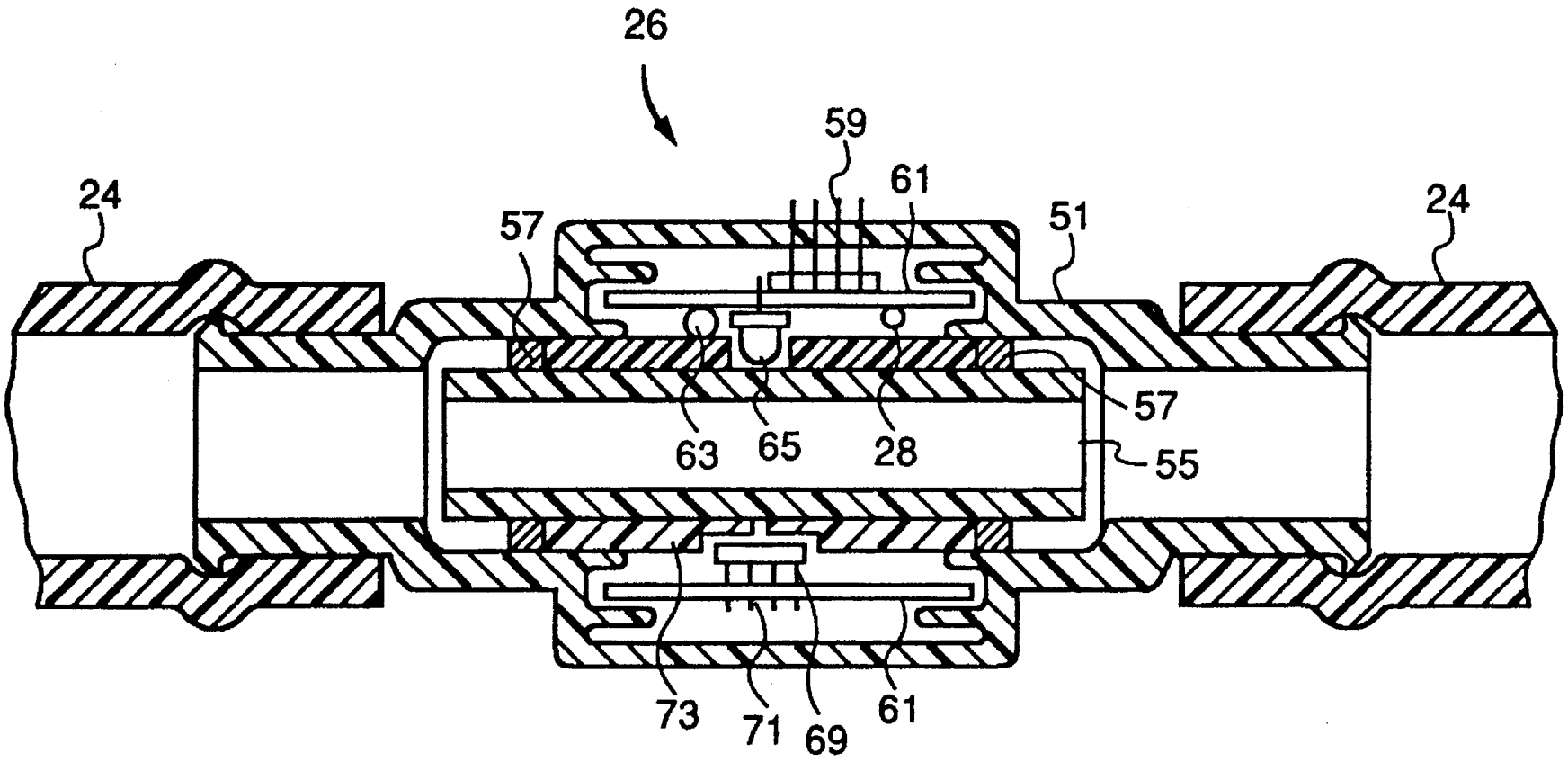
FIG. 2 is a cross-sectional view of a turbidity sensor used in the dishwasher of FIG. 1.

A more detailed view of the turbidity sensor 26 and the temperature sensor 28 is shown in the cross-sectional view of FIG. 2. The turbidity sensor includes a housing 51. At one end of the housing 51 is a fluid flow channel 53 which is coupled to the recirculation hose 24 and permits liquid to flow therethrough. Liquid flows through the fluid flow channel 53 into a quartz tube 55 located inside the housing 51 and coupled thereto by O-rings 57. Located above the top of the quartz tube 55 is a printed circuit board 61 having a light emitting diode (LED) 65, a resistor 63, the temperature sensor 28 which happens to be a thermistor, and a plurality of connectors 59 extending therefrom. At the bottom of the quartz tube 55 is another printed circuit board 61 having various electrical components. In particular, the bottom printed circuit board 61 comprises a light to frequency converter 69, and a plurality of connectors 71. The electronics on the printed circuit boards 61 are positioned within the housing 51 relative to the quartz tube 55 by cylindrical spacer 73. As the liquid flows through the fluid flow channel 53 into the quartz tube 55, electromagnetic radiation emitted by the LED 65 passes through the liquid along an optical axis, which is shown by the dotted line in FIG. 2. The intensity of the light passing through the liquid is inversely proportional to the amount of soil. If there is a high soil level, then there will be a relatively small amount of radiation passing through the liquid, while a lower soil level will have relatively more radiation passing through. The intensity of radiation received at the light to frequency converter 69 is converted into a frequency representation by the light to frequency converter 69 and sent to a controller 30. A more detailed explanation of the turbidity sensor is provided in the aforementioned commonly assigned, co-pending U.S. patent application Ser. No. 08/370,795 [Attorney Docket No. 9D-DW-18700], entitled "Dishwasher With Turbidity Sensing Mechanism", filed on the same date, which is incorporated herein by reference.

Figure 3:
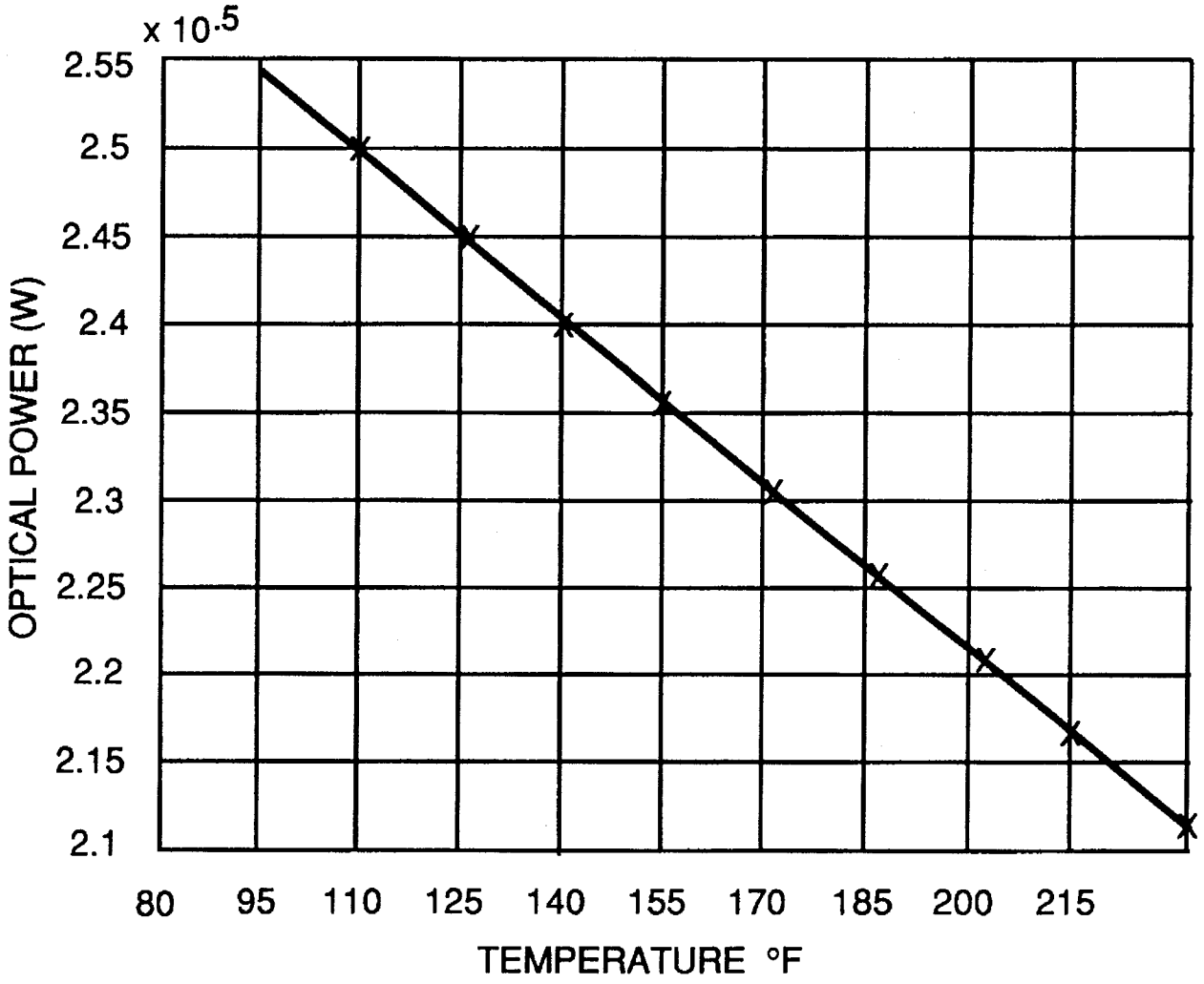
FIG. 3 is a graph showing the effects that temperature has on the optical power of a light emitting diode located within the turbidity sensor.
Figure 4:
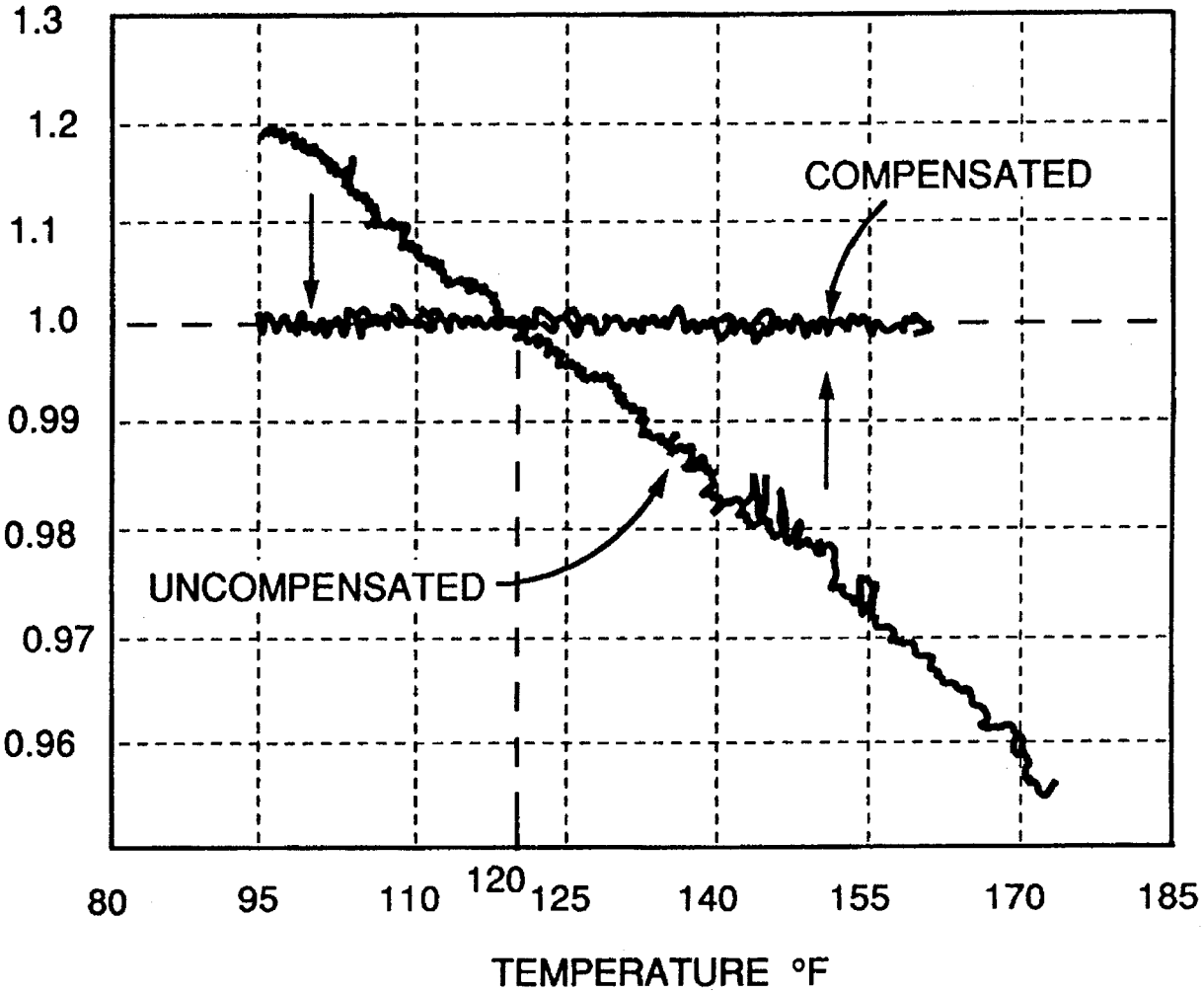
FIG. 4 is a performance curve showing the effects that temperature has on the measured turbidity values.

In addition to receiving the turbidity values, the controller 30 receives the temperature values outputted from the temperature sensor 28. FIG. 3 is a graph showing the relationship between the optical power of the LED 65 and the temperature of the liquid. The graph shows that as the temperature increases, the optical power or brightness of the LED 65 decreases. The effect that the liquid temperature has on the turbidity values measured by the turbidity sensor 26 is shown in the performance curve of FIG. 4. In particular, FIG. 4 shows that as temperature increases, the turbidity values appear to decrease. Turbidity values appear to be decreasing in the performance curve because the optical power or brightness of the LED 65 is decreasing as the temperature increases (see FIG. 3). If the optical brightness is decreasing, then the measured turbidity will decrease, and not accurately reflect the true turbidity values. Thus, the turbidity values measured by the turbidity sensor 26 should be compensated to account for the changes occurring in the temperature.

In the illustrative embodiment, temperature compensation is achieved by determining offset values that are to be added to or subtracted from the turbidity values measured by the turbidity sensor 26, depending on temperature values measured by the temperature sensor 28. The offset values are attained by choosing a temperature reference value that is within the operating temperature range of the t appliance 10. In the illustrative embodiment, the operating range of the appliance 10 is between 75° F. and 165° F. and the temperature reference value is 120° F. Since 120° F. is the temperature reference value, it would be preferred if the measured turbidity values were compensated to reflect the turbidity generated at the reference temperature. The linearization of the turbidity values to the temperature reference value (i.e., 120° F.) is attained by using linear equations. By using linear equations, offset values for all of the possible temperature values in the operating temperature range can be derived and used to compensate the measured turbidity values. In the illustrative embodiment, if the measured temperature values are greater than 120° F., then turbidity values are below the compensated level, and thus, the corresponding turbidity values need to be increased by an offset value to increase their value (see FIG. 4). If the measured temperature values are less than 120° F., then the turbidity values are above the compensated level, and thus, the corresponding turbidity values need to be decreased by an offset value to decrease their value (see FIG. 4). However, if the measured temperature values is equal to 120° F., then the corresponding turbidity values do not need to be offset. In the illustrative embodiment, the offset values are stored in a memory such as a read only memory (ROM) or an electrically erasable programmable read only memory (EEPROM) located within the controller 30. Thus, as the controller 30 receives a turbidity value from the turbidity sensor 26 and a temperature value from the temperature sensor 28, the controller will refer the measured temperature value to the look-up table of offset values. The controller will then read the offset value corresponding to the measured temperature value and adjust the turbidity value accordingly.

Referring again to FIG. 1, measurements from the temperature sensor 28 and the turbidity sensor 26 are sent to the controller 30, which uses the measurements to adjust the operating cycle of the appliance 10 as a function of the soil level of the articles to be washed, the rate of soil removal, and the temperature of the water circulating in the container. The controller then interfaces with various relays and solenoids to provide the proper control action. A first spray arm 32 rotatably supported from ceiling 34 of the container 12, a second spray ann 40 rotatably supported from the bottom of the container, and a nozzle 31 connected to the second spray arm 40 are used to distribute the water onto an upper and lower rack 36 which supports the dishes and utensils in the container during the washing. The first spray arm 32 distributes water to the top portion of the upper rack 36, the second spray arm 40 distributes water to the bottom portion of the lower rack 36, and the nozzle 31 extends up from the second spray arm and distributes water to the bottom portion of the upper rack and the top portion of the lower rack. Water in the sump 22 is heated by a heating element 38 supported within the container 12. When the appliance is operating in the circulation mode, water from the sump 22 is distributed by the first spray arm 32, the second spray arm 40, and the nozzle 31. When the appliance is operating in the drain mode, water is then removed from the sump 22 by the pump 20 and pumped out of the container via an outlet 42.

In the present invention, the dishwasher is provided with an adaptive control system 30 which monitors the turbidity and temperature of the water circulating in the dishwasher and varies the sequence of operations, hereinafter referred to as the operating cycle, as a function of turbidity, temperature, and rate of soil removal signified by the rate of change of turbidity. The operating cycle is varied to adapt to the soil level of the load, thereby minimizing water and energy usage.

In the dishwasher, the complete sequence of operations or operating cycle comprises a wet portion and a o dry portion. The wet portion comprises a series of operations or subcycles hereinafter referred to as Fill Cycles, each including a fill operation, a circulate operation, and a drain operation. The combination of Fill Cycles making up the wet portion of the complete operating cycle includes one or more Pre-Wash Fill Cycles, a Main Wash Fill Cycle, one or more Rinse Fill Cycles and a Final Rinse Fill Cycle. Each of the user selectable operating cycle options, e.g., Normal Wash and Potscrubber Wash, has a pre-determined minimum and maximum number of Pre-Wash Fill and Rinse Fill Cycles. The Normal Wash operating cycle includes a minimum of 4 and a maximum of 6 Fill Cycles; the Potscrubber Wash operating cycle, an extended cycle for heavily soiled loads, includes a minimum of 5 and a maximum of 8 Fill Cycles. However, the number of Fill Cycles actually implemented by the control system 30 varies depending on the soil level of the dishes. More specifically, the control system 30 varies the number of Pre-Wash Fill Cycles and Rinse Fill Cycles as a function of the sensed turbidity, sensed temperature and the rate of soil removal as indicated by the rate of change of turbidity, to adapt the operating cycle to the soil load presented by the dishes.

The Pre-Wash, Main Wash, Rinse and Final Rinse Fill Cycles differ from each other in terms of such parameters as fill time, circulation time, and maximum water temperature. In addition, the Main Wash Fill Cycle includes a detergent dispensing operation and the Final Rinse Fill Cycle includes a rinse-aid dispensing operation. The specific parameters for the various Fill Cycles are listed in the table shown in FIG. 5A for the Normal Wash operating cycle and in the table shown in FIG. 5B for the Potscrubber Wash operating cycle. The information in these tables which indicate the fill time, circulation times, maximum temperature is stored in look-up tables in a memory such as a ROM or EEPROM, which is utilized by the controller when implementing each Fill Cycle.

The tables in FIG. 5A and 5B also include a Main Wash Modifier section which lists those parameters which are varied for the Main Wash Fill Cycle, if one or more Pre-Wash or Rinse Fill Cycles are skipped as a result of the temperature and turbidity sensor inputs. For example, referring to the table in FIG. 5A, if no Fill Cycles are skipped, then the Normal Wash operating cycle would have a total of six Fill Cycles, two Pre-Wash Fill Cycles, a Main Wash Fill Cycle, two Rinse Fill Cycles and a Final Rinse Fill Cycle. If no Fill Cycles are skipped, then the Main Wash Fill Parameters will be the original Parameters listed in the table of FIG. 5A for the Main Wash Fill Cycle. However, depending on the soil load, the adaptive controller may eliminate up to two Fill Cycles reducing the total number of Fill Cycles from six to five, or possibly four. If two Fill Cycles are eliminated, then the Main Wash Modifiers listed for four Fill Cycles are substituted for the original Wash Fill Parameters. Similarly, if one Fill Cycle is eliminated, then the Main Wash Modifiers for five Fill Cycles are substituted for the original Main Wash Parameters. Like the Normal Wash operating cycle, control for the Potscrubber Wash operating cycle will follow the original wash parameters for the four Pre-Wash Fill Cycles until the decision has been made to go to the Main Wash Fill Cycle. If the decision is made to go to the Main Wash Fill Cycle before fill cycle number five, then the control will supersede the original parameters with the modified wash parameters. If the original Pre-Wash Fill Cycle time is less than the modified Fill Cycle time when the decision is made to go to the Main Wash Fill Cycle, then the control will add water to the dishwasher for an amount of time equal to the difference.

The effect of substituting the modifiers is to shorten the duration of the circulation period, and to use a lower maximum water temperature. Water temperature is a significant factor in how rapidly and effectively food soils are broken down. For optimum cleaning performance, it is desirable to bring the water to the maximum temperature listed in the tables of FIGS. 5A–5B by the end of the Main Wash Fill Cycle. Lighter soil loads can be satisfactorily cleaned with a relatively lower maximum temperature. Thus, when the sensor measurements signify soil loads light enough to merit skipping Fill Cycles, a lower maximum temperature can also be employed, thereby further reducing energy consumption. In view of this relationship between final temperature and cleaning performance, the maximum temperature values are used in determining the duration of the circulation time for the Main Wash Fill Cycle as well as in controlling energization of the heater element. As will be apparent from the ensuing description of the method for calculating the maximum circulation time, the lower maximum temperature also tends to further reduce the duration of the circulation period.

For the Main Wash Fill Cycle, the duration of the Main Wash Fill Cycle is varied between the minimum and maximum values as a function of water temperature. The minimum circulation time is the Circulation Time, listed in the tables of FIGS. 5A–5B. The maximum circulation time is listed Circulation Time plus the Extended Time. The heating element 38 in the dishwasher has associated with it an empirically determined constant of K representing the rate of water temperature increase, expressed in degrees per minute. The controller 30 computes the temperature difference ΔT between the specified maximum temperature and the sensed temperature taken at the end of the previous fill operation. The time required to reach the maximum temperature is calculated by dividing ΔT by the constant K. If this value of time is greater than the minimum specified circulation time, and is less than the maximum circulation time, then this calculated time is used as the Circulation Time.

The controller 30 processes sensor data in a manner hereinafter described in greater detail to assess the soil level of the load. If this data indicates a desired degree of soil removal has been achieved, the wash control program for the selected operating cycle will be adjusted to eliminate one or more subsequent Fill Cycles. As previously mentioned, a decision to eliminate one or more fill cycles also results in adjustments to the duration of the Main Wash Fill Cycle.

Figure 6:
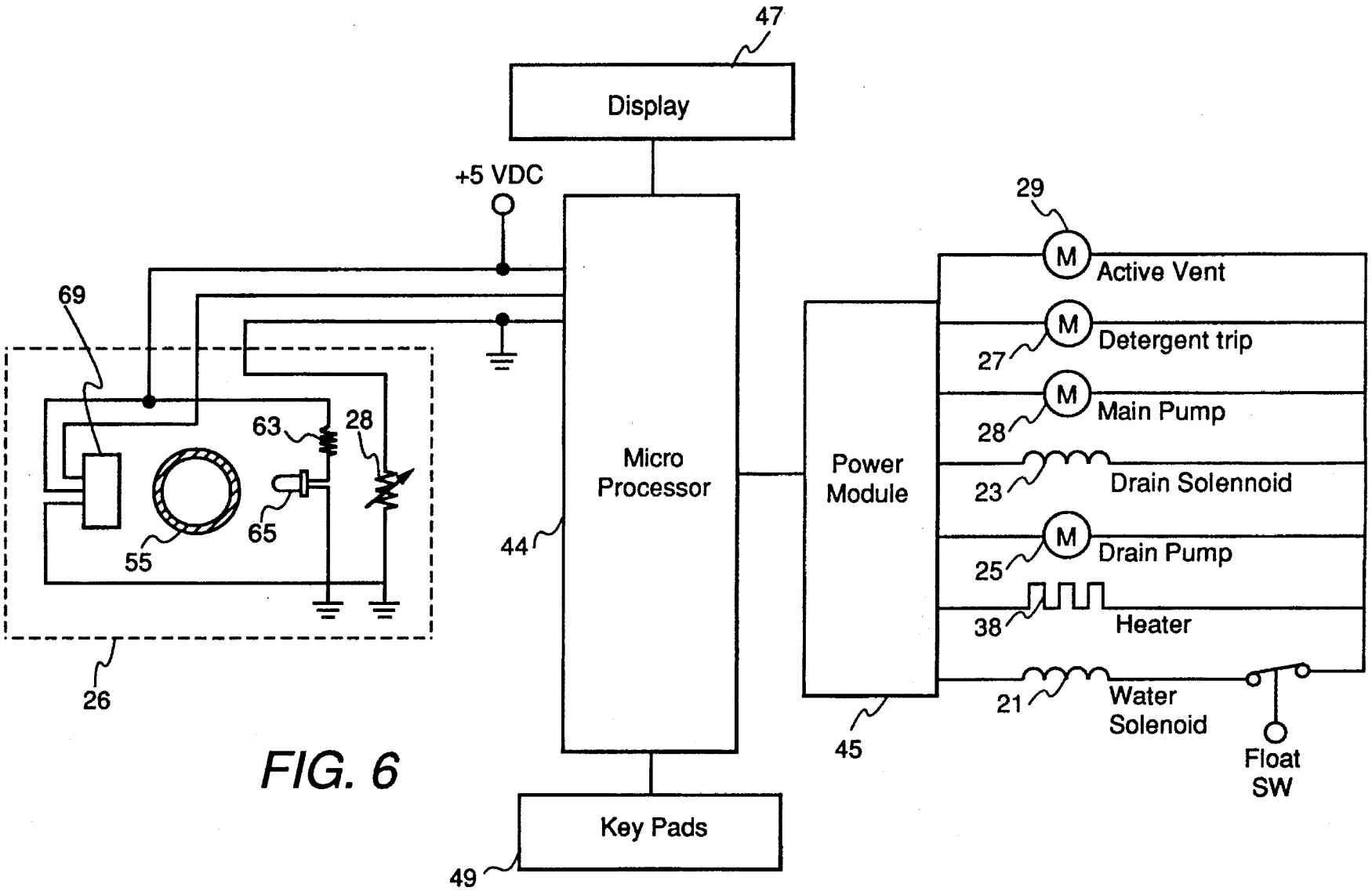
FIG. 6 is a schematic circuit diagram of the control circuits used in the dishwasher of FIG. 1.

Referring now to FIGS. 6–11, the controller will be described in greater detail. FIG. 6 is a block diagram of the electronics used for controlling the operating cycle of the dishwasher. In FIG. 6, a microprocessor 44 receives an input from the turbidity sensor 26 which provides a frequency output from 50 to 150 kHz that is inversely proportional to the turbidity of the water. Clean water measurements will typically be around 40 kHz, while very dirty water will be around 5 kHz. The microprocessor 44 also receives an input from the temperature sensor 28 which senses the water temperature. The temperature sensor 28 is preferably a 50K NTC thermistor that is integrated into the turbidity sensor 26 and used to compensate for temperature in the turbidity sensor. The microprocessor 44 also receives status information from other devices which are not shown in FIG. 6 such as a detergent feedback, a drain feedback, a door latch, an overfill feedback, and an active vent feedback. The detergent feedback device is a low voltage switch that provides a detergent feedback signal when the switch is closed to logic ground when the switch is in the home position. The drain feedback device is a low voltage switch that provides a drain feedback signal when the switch is closed to logic ground when the gate valve is in the drain position. The door latch provides a 60 Hz signal when the door to the dishwasher is latched. The overfill feedback device will notify the microprocessor 44 if there is an overfill condition (i.e., the water level in the dishwasher has exceeded a pre-determined limit). The active vent feedback device will notify the microprocessor 44 when the active vent is in the home position.

The status information received from the turbidity sensor 26, the temperature sensor 28, the detergent feedback device, the drain feedback device, the door latch device, the overfill feedback device, and the active vent feedback device, is processed by the microprocessor 44 to control components such as the pump 20, a water valve 21, the heater element 38, a drain solenoid 23, a drain pump 25, a detergent trip motor 27, and an active vent motor 29. The drain solenoid 23 operates a valve on the pump 20 and is energized for about five seconds, allowing it to drain until the water pressure drops to a minimum level. The drain pump 25 is an auxiliary pump located in the drain system that will completely evacuate the dishwasher sump for selected drains. The detergent trip motor 27 provides detergent during the Main Wash Fill Cycle and rinse agent during the Final Rinse Fill Cycle. The active vent 29 is closed during the wet portion and open during the dry portion.

The control outputs from the microprocessor 44 are communicated to the pump 20, the water valve 21, the heater element 38, the drain solenoid 23, the drain pump 25, the detergent trip motor 27, and the active vent 29, through a power module 45. The power module 45 includes a transformer to step down a 120 VAC to low voltage AC, rectification and filters for AC to DC conversion, and relays to switch power for the main pump motor 20, the water fill solenoid 21. the drain pump motor 25, the drain solenoid 23, the heater 38, the active vent motor 29, and the detergent trip motor 27.

A display 47 provides visual feedback to a user. The display is preferably a vacuum fluorescent display that displays cycle selection, cycle status, energy monitor bars, option selection, and delay start time. The display informs the user if the dishwasher is in the Normal Cycle or the Potscrubber Wash operating cycle. Also, the display 47 tells the user if the dishwasher is washing, drying, cleaning, or rinsing and other operating information. Keypads 49 enable the user to select the desired operating cycle, e.g., Normal Wash Cycle or the Potscrubber Wash operating cycle.

Figure 7:
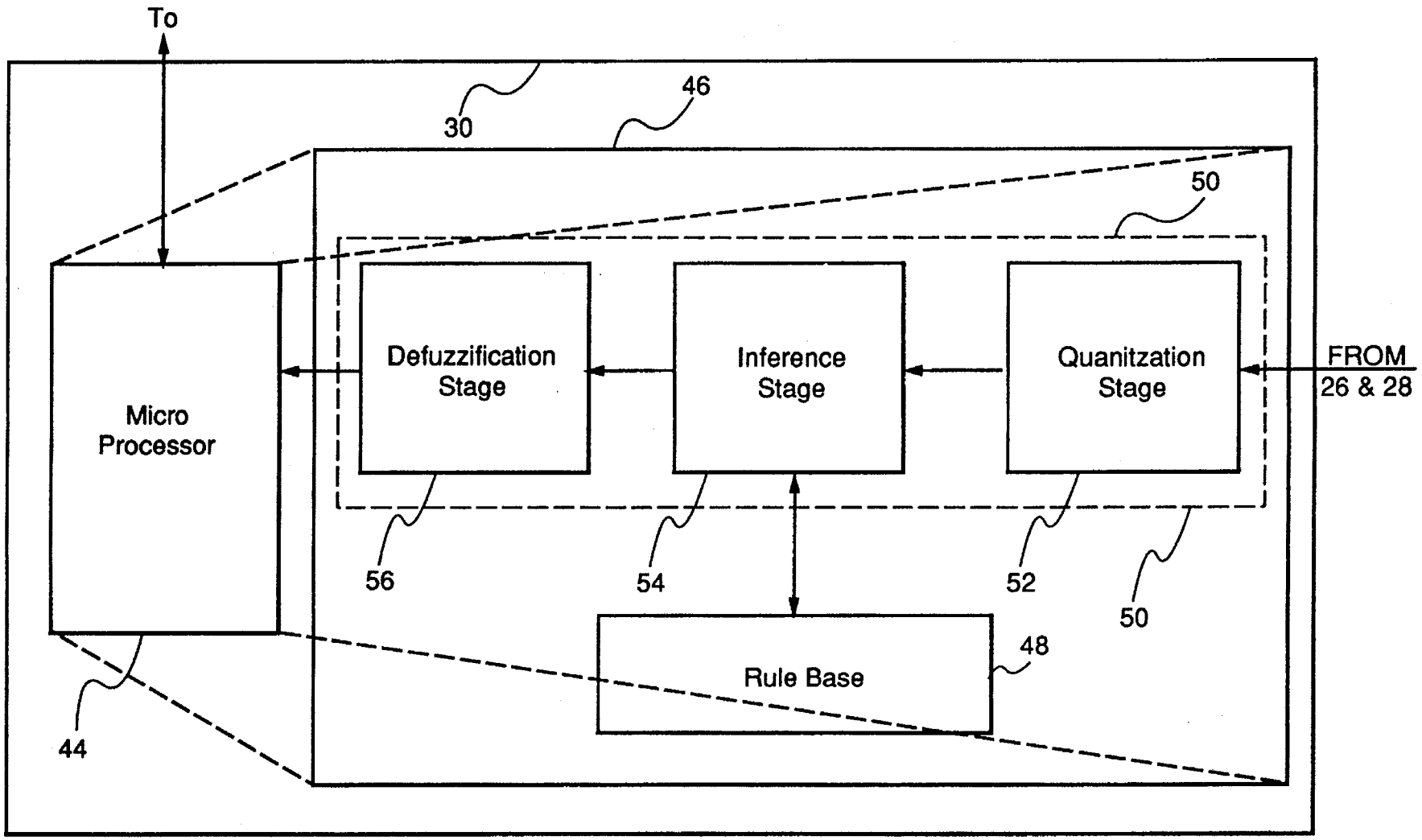
FIG. 7 is block diagram of the controller embodied in the microprocessor of FIG. 6.

As mentioned above, the operating cycle of the appliance 10 is controlled by the controller 30 which is shown in further detail in FIG. 7. The controller includes the microprocessor 44 which comprises a decision system 46 for processing the sensor input data to determine whether or not to skip one or more Fill Cycles to adapt the selected operating cycle to the load. The decision system 46 is preferably a fuzzy logic system, but a linear system, or a non-linear system is within the scope of the present invention. The fuzzy logic system includes a rule base 48 comprising of a set of fuzzy rules that are used in conjunction with an interpreter 50. The interpreter includes a quantization stage 52, an inference engine or stage 54, and a defuzzification stage 56. In the fuzzy logic system, the quantization stage receives inputs from the turbidity sensor 26, the temperature sensor 28, and a turbidity derivative computed by the microprocessor, which is the change in turbidity from the previous fill cycle to the current cycle (i.e., previous turbidity—current turbidity). The quantization stage takes these inputs and makes them dimensionally compatible with the rules in the rule base. The inference engine matches each of the rules in the fuzzy rule base to the input values from the turbidity sensor, the temperature sensor, and the computed turbidity derivative. Also, the inference engine aggregates the rules that were found to have a partial match and generates a confidence value. The defuzzification stage uses a maximum dot centroid method to summarize the confidence value into a number which is then used by the microprocessor and compared to a predetermined threshold value. As will be hereinafter described in greater detail, if the confidence value is greater than the predetermined threshold value, then the controller will either skip or start a Fill Cycle. Those skilled in the art will realize that there are many design choices which can be made in the implementation of a fuzzy logic system, and the present invention is not limited to the above implementation.

Figure 8:
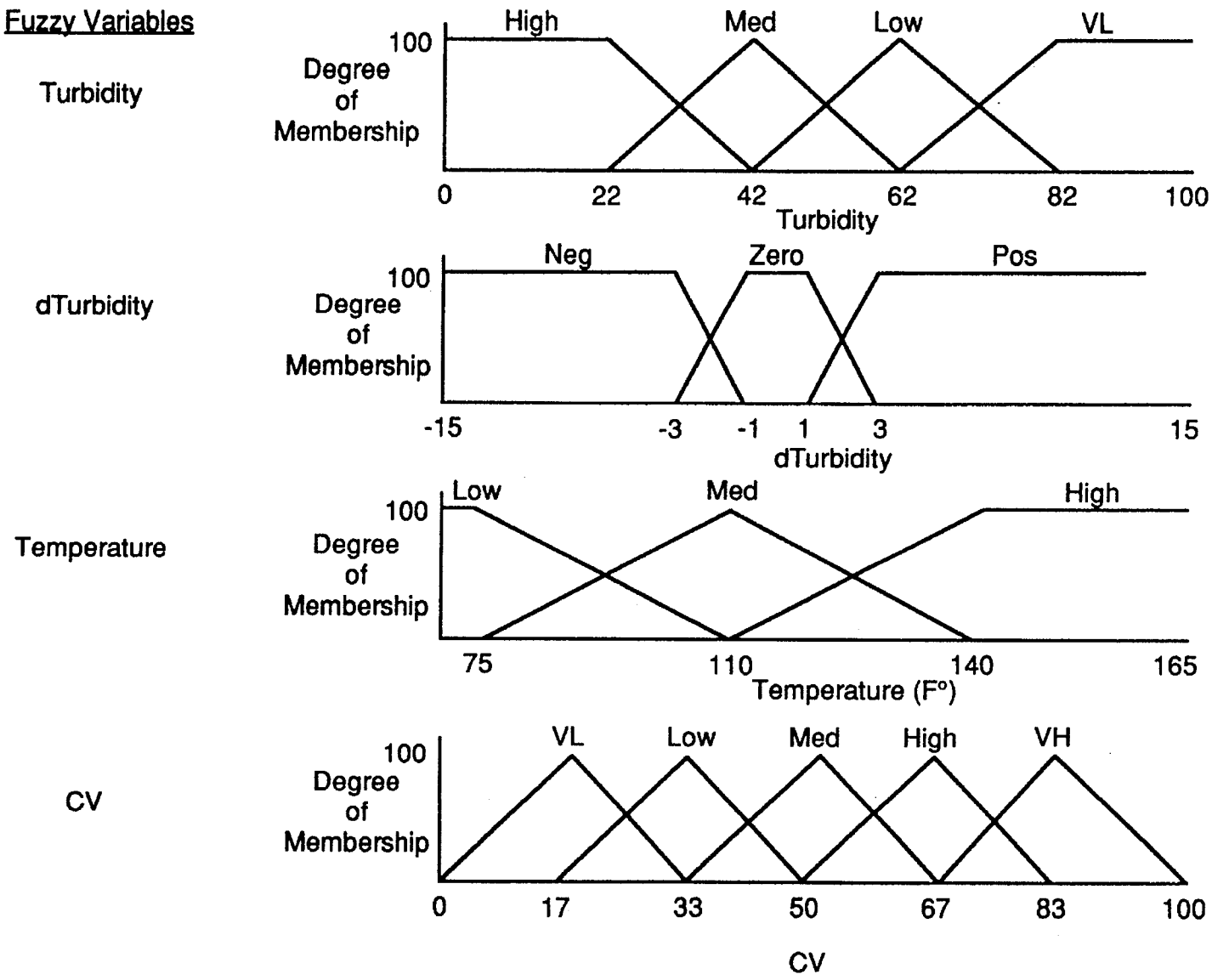
FIG. 8 is a diagram of the fuzzy set variables and values used by the controller of FIG. 7.
Figure 10:
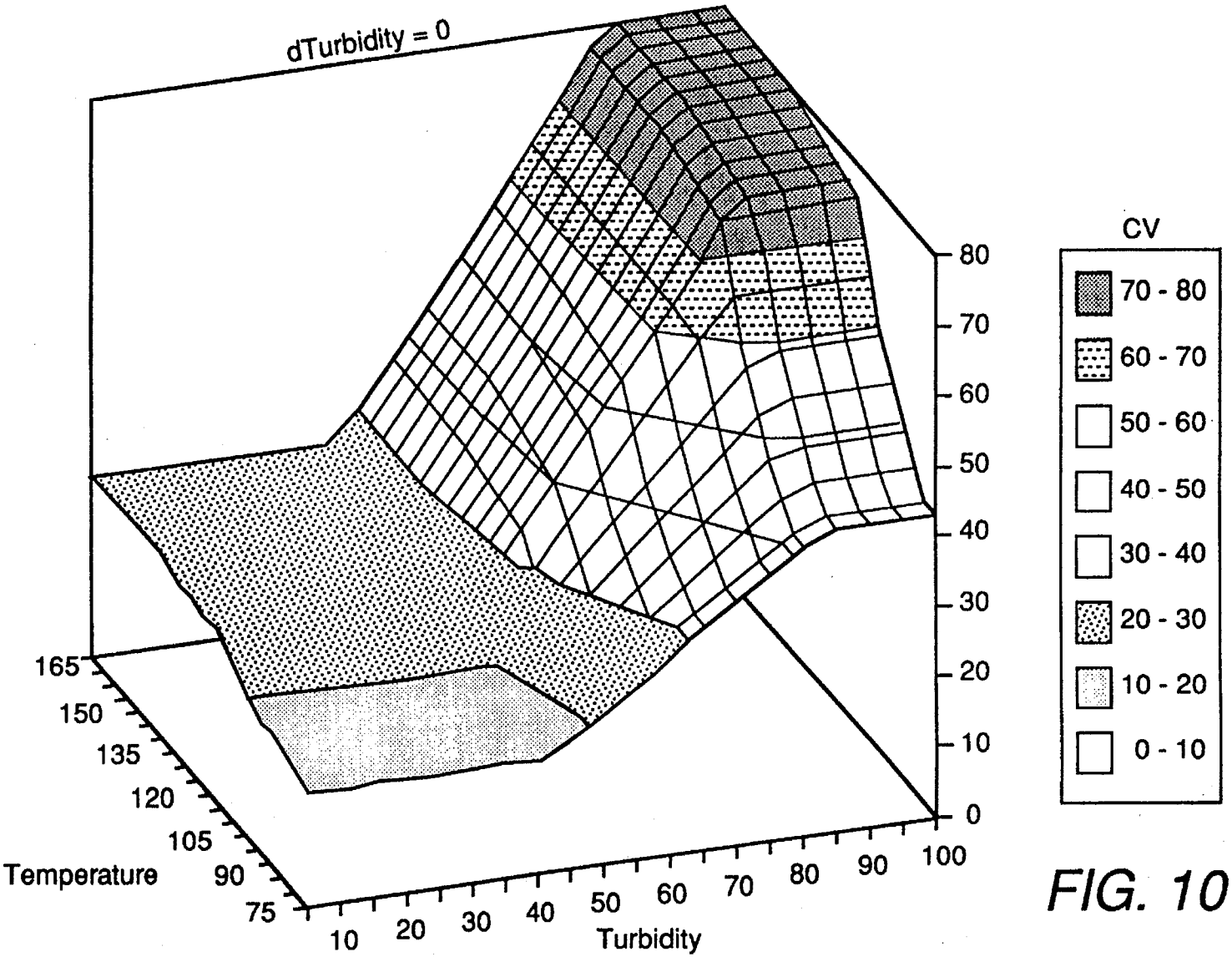
FIG. 10 is a control surface for the controller of FIG. 7.

In the decision system 46, the variables are temperature, turbidity, derivative of turbidity, and confidence value. In particular, the temperature, turbidity, and derivative of turbidity measurements are used to determine a confidence value. The fuzzy sets for the variables and their respective membership values are shown in FIG. 8. In particular, the variable turbidity has sets separated into very low (VL), low (LOW), medium (MED), and high (HIGH); the derivative of turbidity (dTurbidity) variable has sets separated into negative(NEG), zero (ZERO), and positive (POS); the temperature variable has sets separated into low (LOW), medium (MED), and high (HIGH); while the confidence variable (CV) has sets separated into very low, low, medium, high, and very high for confidence value. Note that each fuzzy set has a corresponding membership function that returns the degree of membership or belief, for a given value of the variable. Membership functions may be of any form, as long as the value that is returned is in the range of [0,1]. For example, in the preferred embodiment, if the variable turbidity has a value ranging from zero to 21, then it fits 100% into the high fuzzy set. If the turbidity variable has a value from 22 to 42, then the value will have a degree of membership in the high and medium fuzzy sets. If the turbidity variable has a value from 43 to 62, then the value will have a degree of membership in the medium and low fuzzy sets. If the turbidity variable has a value from 63 to 81, then the value will have a degree of membership in the low and very low fuzzy sets. If the variable turbidity has a value ranging from 82 to 100, then it fits 100% into the very low fuzzy set. The other variables (i.e., dTurbidity, temperature, and CV) have similar regions of overlap between respective fuzzy set values. Like the fuzzy set values for turbidity, the fuzzy set values for dTurbidity, temperature, and CV, have similar membership functions that return values in the range of [0,100].

The fuzzy sets associate the input variable values for turbidity, dTurbidity, temperature, to the output variable value for CV. The association is attained by the fuzzy rules stored in the rule base 48. The fuzzy rules comprise one or more antecedents and a conclusion comprising one or more consequences. For example, one rule may be:

If (Turbidity is VL) AND (dTurbidity is NEG) THEN CV is VH

In this example, the antecedents are If (Turbidity is VL) AND (dTurbidity is NEG). If the antecedents are met, then the conclusion for CV is VH. A collection of these rules make up a fuzzy system which takes inputs and produces outputs depending on which rules are fired. In a fuzzy system, a rule will fire if its premise evaluates a non-zero belief level. When a rule fires, it contributes to the output of the fuzzy system. The rules in a fuzzy system fire to different degrees. Rather than an all or nothing response, the fuzzy rules produce "shades of gray" responses, depending on the degree of belief in the premise of each rule. In addition, more than one rule may fire for a given group of inputs, so the output of the fuzzy system may be the combined result of several rules.

The rules utilized in the illustrative embodiment follow:

Rule 1:
IF (Turbidity IS VL) AND (dTurbidity IS NEG) THEN CV=VH

Rule 2:
IF (Turbidity IS VL) AND (dTurbidity IS ZERO) THEN CV=VH

Rule 3:
IF (Turbidity IS VL) AND (dTurbidity IS POS) THEN CV=HIGH

Rule 4:
IF (Turbidity IS LOW) AND (dTurbidity IS NEG) THEN CV=HIGH

Rule 5:
IF (Turbidity IS LOW) AND (dTurbidity IS ZERO) THEN CV=MED

Rule 6:
IF (Turbidity IS LOW) AND (dTurbidity IS POS) THEN CV=LOW

Rule 7:
IF (Turbidity IS MED) AND (dTurbidity IS NEG) THEN CV=LOW

Rule 8:
IF (Turbidity IS MED) AND (dTurbidity IS ZERO) THEN CV=VL

Rule 9:
IF (Turbidity IS MED) AND (dTurbidity IS POS) THEN CV=VL

Rule 10:
IF (Turbidity IS HIGH) AND (dTurbidity IS NEG) THEN CV=VL

Rule 11:
IF (Turbidity IS HIGH) AND (dTurbidity IS ZERO) THEN CV=VL

Rule 12:
IF (Turbidity IS HIGH) AND (dTurbidity IS POS) THEN CV=VL

Rule 13: WEIGHT=1.50
IF Temperature is LOW THEN CV=VL

Rule 14: WEIGHT=0.25
IF Temperature is MED THEN CV=MED

Rule 15: WEIGHT=0.25
IF Temperature is HIGH THEN CV=HIGH

These fuzzy rules and their relationship between the input variables and the output variables are shown in tabular form in the rules tables of FIG. 9. In particular, the rules tables indicate what the confidence value will be for the output variable for a particular input value from the temperature, turbidity, and derivative of turbidity variables. For example, if the derivative of turbidity is zero and the turbidity is medium, then confidence value will be very low. If the derivative of turbidity is positive and the turbidity is very low, then confidence value will be medium. Generally, a light soil level will need a shorter wash operating cycle, while a heavy soil level will need a longer wash operating cycle. In addition, the rule tables show that if the temperature is low, then the confidence value is very low; if the temperature Is medium, then the confidence value is medium; and if the temperature is high, then the confidence value is high. In the illustrative embodiment, the temperature rules each have an associated rule weight that influences the rules for turbidity and derivative of turbidity. The rule weight associated with Rules 1–12 is 1.0; the weight associated with Rules 13–15 is listed above, and in FIG. 9. Thus, a high temperature increases the likelihood of shortening a wash operating cycle, while a low temperature increases the likelihood of lengthening a wash operating cycle. These rules and their association with the input and output variables are shown in further detail in the control surface of FIG. 10, which illustrates the relationship of the confidence value CV to the temperature and turbidity variables at a particular value for the derivative of turbidity, specifically a constant value of zero.

When a fuzzy rule fires, it fires to a certain degree depending on the belief level in each antecedent in the premise of the rule. The antecedents are evaluated using membership functions to produce belief levels, which are then combined using fuzzy operators to produce the final output activation level. Finally, the output activation level is used to either scale or clip the fuzzy output set. Clipping the output is called Max-Min inference and scaling the output is called Max-Dot inference. The higher activation level for a rule, the more it will contribute to the combined output of all the rules. Once all of the fuzzy output sets have been computed, they are summed or unioned together to produce the combined fuzzy output set. As mentioned o earlier, the Max-Dot/Centroid inference is the preferred defuzzification technique used in the illustrative embodiment. The Max-Dot/Centroid inference defuzzification technique uses the following equation to compute the final value for the output variable CV:

$$CV = \frac{\sum_{i=1}^{n} \alpha_i M_i W_i}{\sum_{i=1}^{n} \alpha_i A_i W_i}, \quad (6)$$

wherein $\alpha_i$ is the rule applicability, $M_i$ is the moment of the membership function, $W_i$ is the weight assigned to rule i, and $A_i$ is the area of the membership function. Other well known defuzzification methods such as Max-Min, Mean of Maxima, and Height Method, could also be used to perform evaluation and defuzzification.

Figure 11:
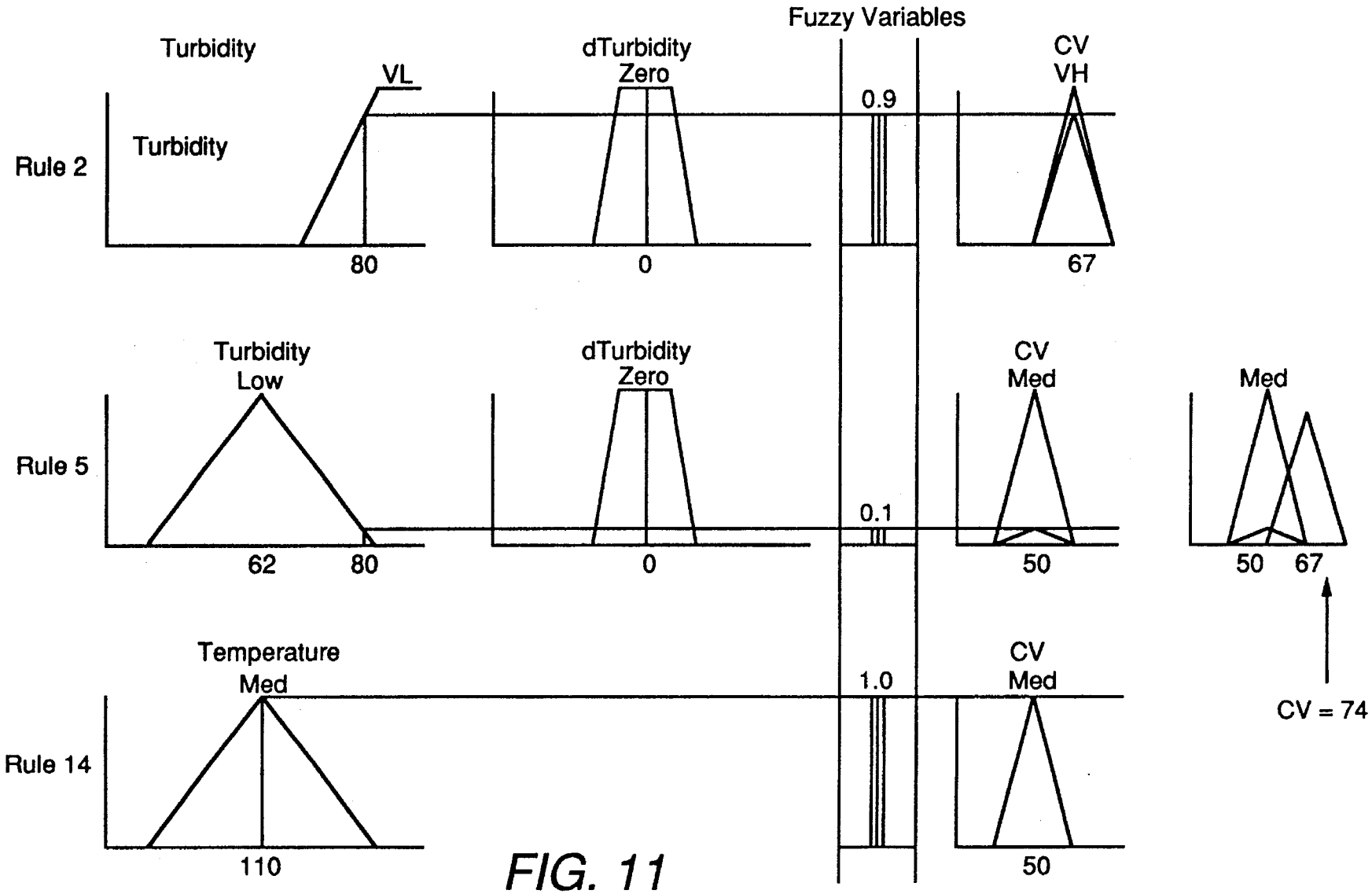
FIG. 11 shows an example of fuzzy rule evaluation and defuzzification.

An example of how the illustrative embodiment evaluates the fuzzy rules is shown in FIG. 11. In this example, the input value for turbidity is 80, dTurbidity is zero, and temperature is 110. For the given input variable values, there are three rules which will fire to some degree. The degree of applicability of the three rules to the respective inputs are shown in the column marked rule applicability and denoted by a thermometer-type icon. In FIG. 11, Rule 2 has a rule applicability of 0.9, Rule 5 has a rule applicability of 0.1 and, Rule 14 has a rule applicability of 1.0. The output (i.e., CV) of each rule is shown in a scaled distribution at the right-hand column of FIG. 11. The output for each rule is attained by using the above-described Max-Dot/Centroid Inference/defuzzification method. Since the three rules fire to some degree, their respective output distributions are summed together to form an output distribution, which is shown in the far right-hand column of FIG. 11. A single CV output value is achieved by taking the centroid or average. In this example, the output value for CV is 74. The fuzzy system then uses the CV output value and compares it to a threshold value. Depending on what the values are for CV and the threshold, the fuzzy system will either start, skip or modify a machine Fill Cycle and adjust the machine operating cycle duration.

The operation of the controller is described in further detail in FIGS. 12–22. Once the dishwasher is ready to be used, the user closes the door and enters the desired operating cycle through the keypad 49. In the illustrative embodiment only two operating cycles, Normal Wash and Potscrubber Wash are described in detail. However, a fully featured dishwasher would allow the user to select additional operating cycles such as a China Crystal Cycle, and a Rinse & Hold Cycle. After choosing a desired operating cycle, the user has the option of using the keypad 49 to delay the start of the machine until a later time, lock the keypad so that the operating cycle can run without any interruption, clear the selected operating cycle, choose another operating cycle, and choose an Energy Saver Dry cycle to save energy. In addition, if the user does not want to select a desired operating cycle, then a default operating cycle will be chosen. Once the desired operating cycle is selected, the controller 30 starts the dishwasher using the selected operating cycle. The display then provides the user with status information throughout the operating cycle.

Figure 12:
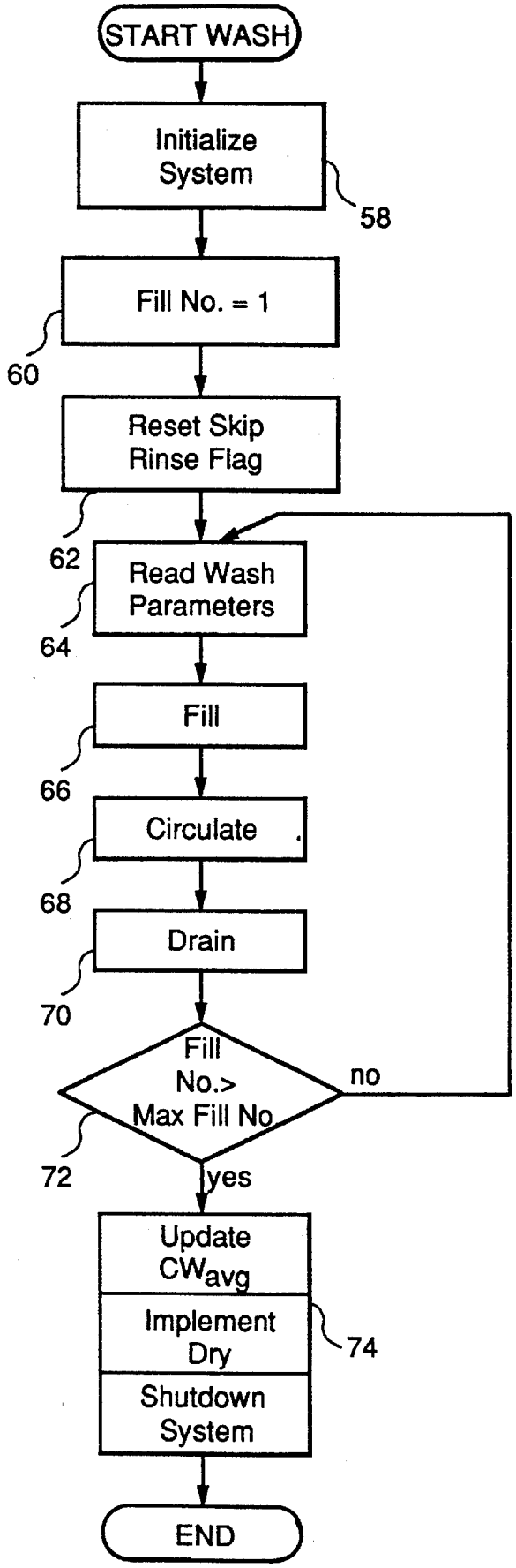
FIG. 12 is a top level flow chart of the controller of FIG. 7.

The operation of the dishwasher 10 by the controller 30 after it has been started, is now described with reference to the flow charts set forth in FIGS. 12–22. FIG. 12 is top level flow chart describing the operating cycle. After the operating cycle has been initiated by the user or the delay timer at 58, the controller initializes the fuzzy system by assigning values to variables (i.e., turbidity, derivative of turbidity, temperature, and CV) stored in a random access memory (RAM) to check the state of the appliance 10. Also, the fill number count is set to one at 60 and the skip rinse flag is set to false at 62. At this point, the appliance is ready to begin the wash operation.

As hereinbefore described, the operating cycle comprises a sequence of Fill Cycles comprising one or more Pre-Wash Fill Cycle, a Main Wash Fill Cycle, and one or more Rinse Fill Cycles including a Final Rinse Fill Cycle. As shown in FIG. 12, each fill cycle comprises primarily four operations, reading wash parameters at 64, filling the appliance with water at 66, circulating the water at 68, and draining the water from the appliance at 70. At the reading wash parameters step, variables for the Fill Cycle are retrieved from look-up tables containing the data shown in tables 5A and 5B. During the fill operation, a timed fill of about 80 seconds duration brings clean water into the appliance for washing. Following the fill, the water is circulated by the pumping action of the wash system. The duration of the circulation period is determined by the controller. Following the circulation period, the controller drains the water together with particulates removed from the articles being washed and detergent or rinse agent that was added during that Fill Cycle. At 72, the number of Fill Cycles that are performed is determined by the maximum fill values stored in the controller. After the appropriate number of Fill Cycles have been performed, the operating cycle is terminated at 74.

Figure 13:
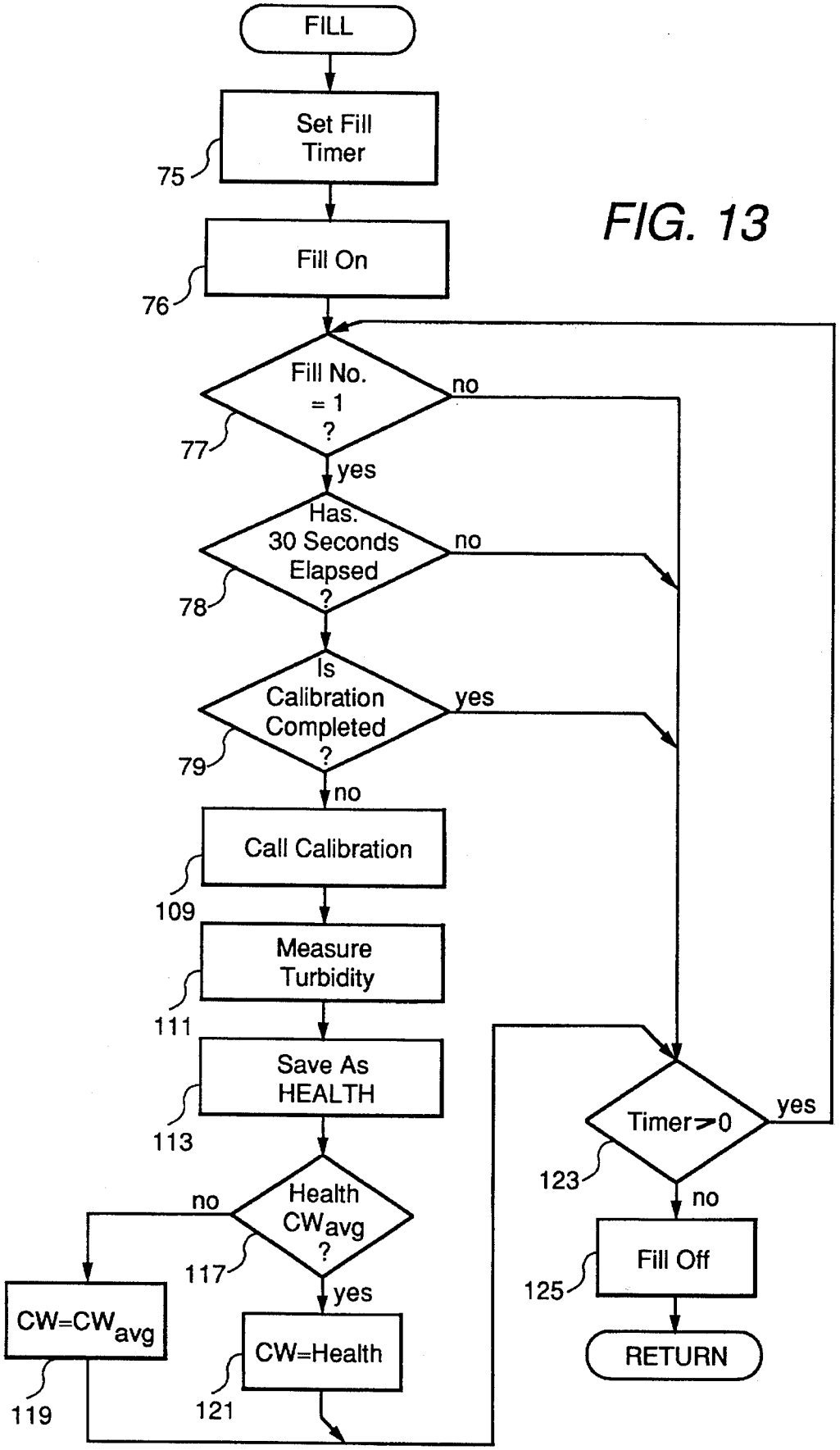
FIG. 13 is a flow chart of a FILL routine.

FIG. 13 is a flow chart describing the fill operation shown in FIG. 12. During this operation, a fill timer determines the duration of the fill operation, which controls the quantity of clean water being provided to the appliance; the turbidity sensor is calibrated; and the Clean Water reference value (CW) is established.

At the beginning of the fill operation, the controller initializes the fill timer at 75 and energizes the water fill solenoid 21 at 76 to cause fresh water to enter the appliance. The water valve remains on until the fill timer has expired. In particular, as shown in FIG. 13, the controller checks the status of the timer at 123. When the timer times out, the water fill solenoid 21 is de-energized at 125 thereby terminating the fill operation.

In the illustrative embodiment, the turbidity sensor self calibrates during the Initial fill operation. This allows a turbidity measurement for clean water that is not altered by the influence of turbulence, food particulate, and air bubbles. The calibration compensates for the variability and aging of the turbidity sensor's components, as well as for the variability in the turbidity of clean water. The objective of the calibration operation is to determine the optimal length of time to count the turbidity sensor's pulses. If an appropriate length of time is not determined, the turbidity sensor 26 will count either too few counts or too many counts causing erroneous measurements during the wash. In the illustrative embodiment, the turbidity calibration operation adjusts the optimal length of time or measurement interval so that the turbidity sensor 26 outputs between 32,512 and 49,152 pulses for clean water. For example, if the measurement interval is one second and the controller 30 counts 60,000 pulses generated from the turbidity sensor 26, then the controller will determine that the 60,000 pulses exceeds the 49,152 count limit so the measurement will be reduced by 200 milliseconds to 0.8 seconds. Thus, for the same clean water, the count will now be 48,000. Since 48,000 is within the limits, the calibration routine makes no further adjustments to the measurement interval.

Figure 14:
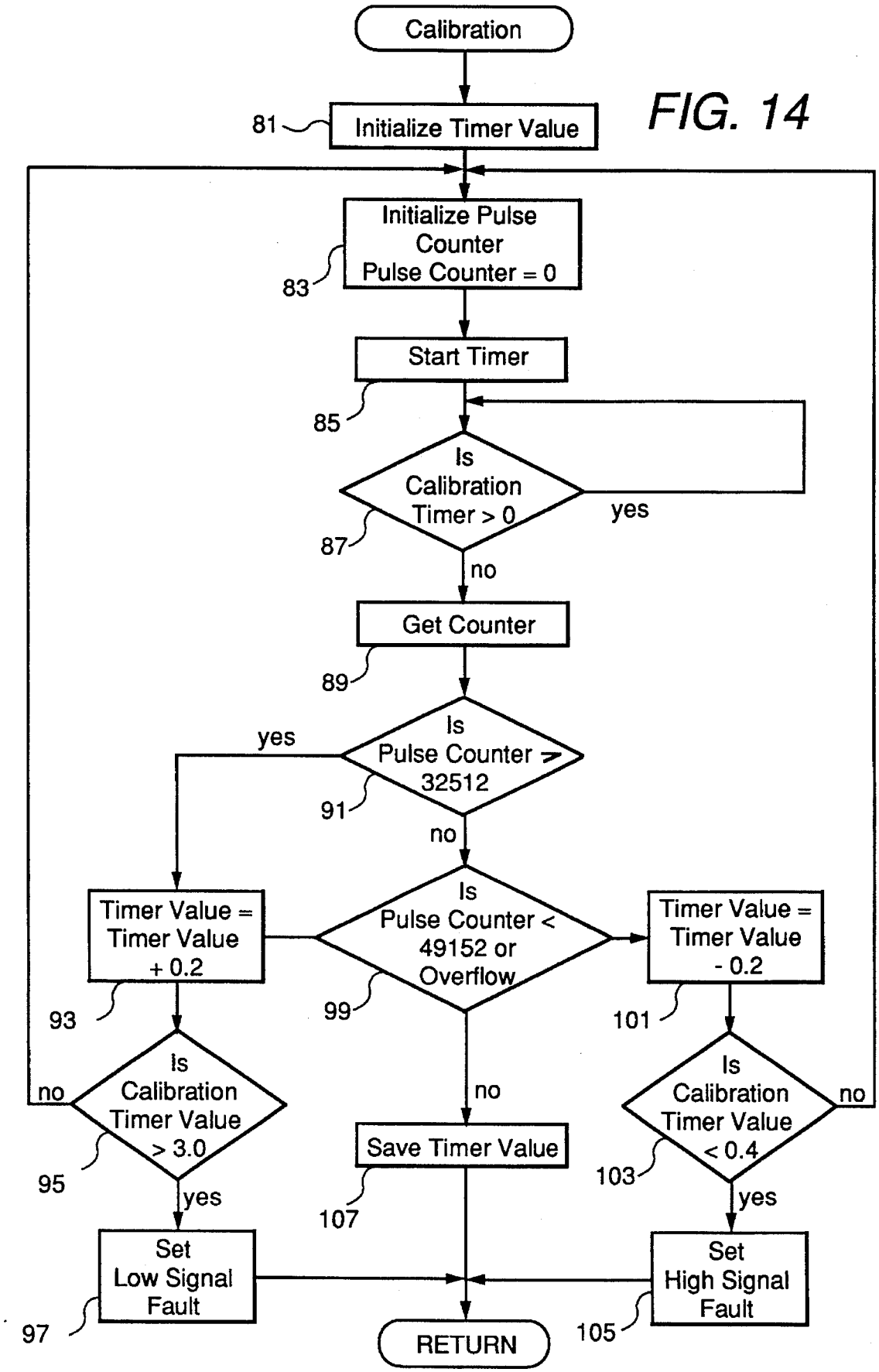
FIG. 14 is a flow chart describing the turbidity calibration routine.
Figure 15:
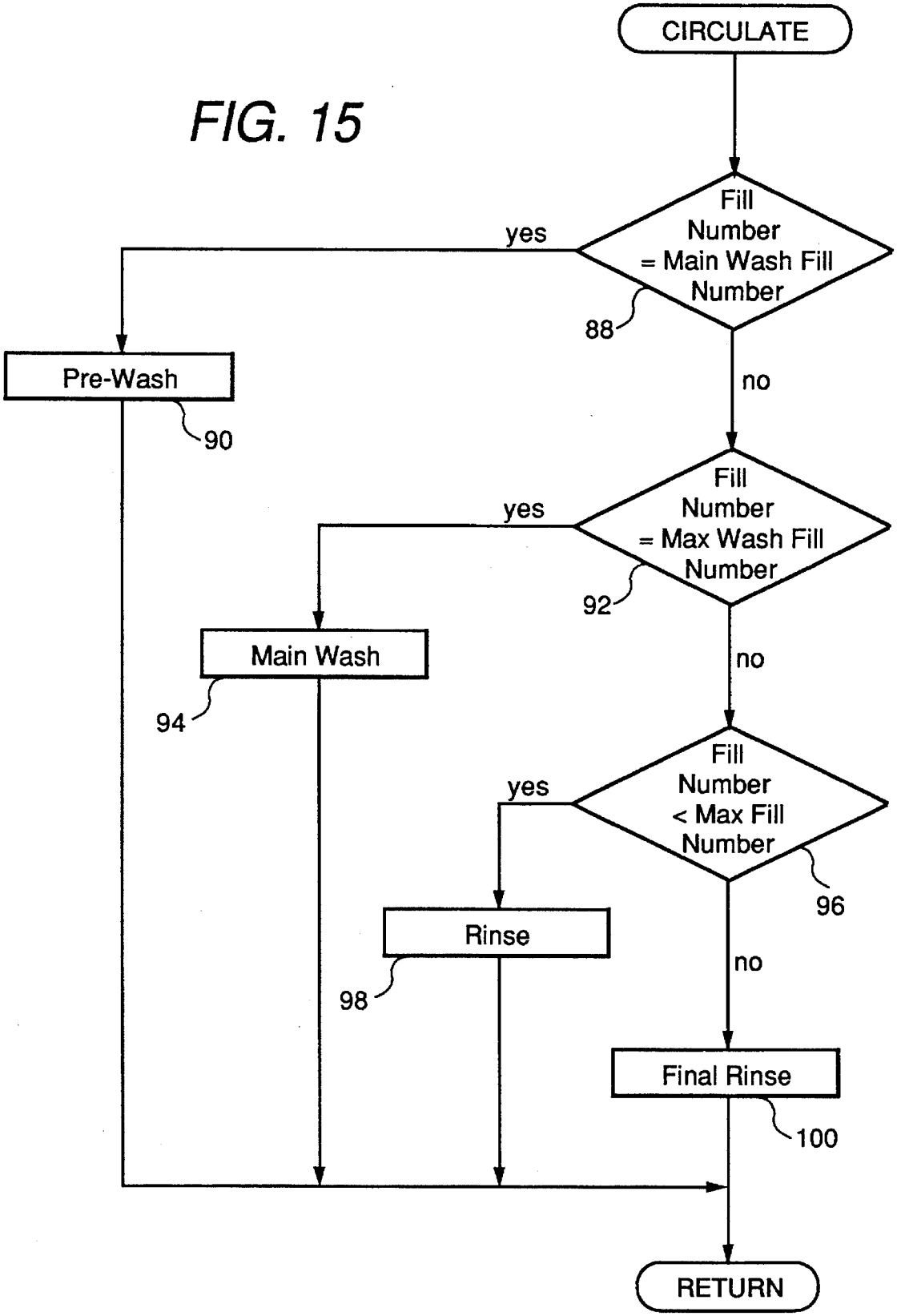
FIG. 15 is a flow chart depicting the main operations of the circulation phase of a machine cycle.

Referring again to the fill routine illustrated in FIG. 13, Blocks 77 and 78 cause the calibration routine of FIG. 14, to be called at 109 during the first fill operation, i.e. during the fill operation for Fill Cycle Number 1, after the first 30 seconds of fill time has elapsed.

The turbidity calibration operation is now described in the flow chart of FIG. 14. As mentioned above, the calibration operation determines the optimal measurement interval for the turbidity sensor 26 to output pulses for clean water. At 81, the calibration timer is set to the calibration Timer Value representing the measurement interval established during the prior calibration. In the illustrative embodiment, the calibration Timer Value is in the range of 0.4 seconds to 3.0 seconds, with the initial value being initially preferably set at 1.0 seconds during power up of the control system, which is a routine not described, but which is executed only upon restoration of power to the system following a power interruption. Thereafter, the initial Timer Value will be the value determined during the preceding operating cycle. Also, a pulse counter is initialized at 83 and set to zero. After initialization, the calibration timer is started at 85 and the pulse counter begins a count of the number of output pulses generated from the turbidity sensor 26. As long as the calibration timer has not expired to zero at 87, the pulse counter maintains the count of the number of output pulses generated from the turbidity sensor 26. Once the calibration timer has expired to zero at 87, the pulse count is taken from the pulse counter at 89. If the pulse count is less than 32,512 at 91, then the calibration timer value is increased by 0.2 at 93. Then the new calibration Timer Value is Compared at 95 to determine if it is greater than 3.0. If the new calibration Timer Value is greater than 3.0, then a LOW SIGNAL FAULT is flagged at 97. A LOW SIGNAL FAULT is an indication that the turbidity sensor is in a failure mode. Typically, LOW SIGNAL FAULTs are due to electrical failures such as a failed LED, a failed receiver, low power or mechanical problems such as a blocked optical path or a degraded optical window. If a LOW SIGNAL FAULT is flagged, the calibration operation ceases and the controller invokes a default operating cycle. If the new calibration Timer Value is less than 3.0, then calibration operation returns to 83 and starts over. If the pulse count is greater than 32,512 at 91, then the pulse count is examined at 99 to determine if it is greater than 49,152. If the pulse count is greater than 49,152 at 99, then the calibration Timer Value is decreased by 0.2 at 101. Then the new calibration Timer Value is compared at 103 to determine if it is less than the 0.4. If the new calibration Timer Value is less than 0.4, then a HIGH SIGNAL FAULT is flagged at 105. Typically, HIGH SIGNAL FAULTs are due to electrical failures such as a higher intensity LED, an increase in power to the turbidity sensor 26, or mechanical problems such as a an intermittent connection. If a HIGH SIGNAL FAULT is flagged, the calibration operation ceases and the controller invokes a default operating cycle. If the new calibration Timer Value is greater than 0.4, then the calibration operation returns to 83 and starts over. If the pulse count is less than 49,152 at 99, then this calibration Timer Value, representing the measurement interval is saved at 107 and the program returns to the fill routine of FIG. 13.

After the turbidity sensor 26 has been calibrated and its measurement interval has been adjusted and saved, the turbidity sensor is ready to take turbidity measurements. In the description to follow reference will be made to turbidity measurements. Each such measurement actually consists of four successive turbidity sensor reading, which are averaged to smooth the data. Consequently, each measurement value represents the average of four sensor readings.

Referring again to the fill routine of FIG. 13, following completion of the calibration of the sensor the Clean Water reference value (CW) is determined, beginning at 111, with a turbidity measurement which is stored in memory as the HEALTH Value, at 113.

This HEALTH value is then compared at 117 to an average Clean Water value, referred to as the CLEAN $WATER_{avg}$ or $CW_{avg}$, which is the rolling average of the preceding eight Clean Water values determined during the preceding eight machine operating cycles.

The Clean Water reference value CW for the current operating cycle will be the larger of the HEALTH Value or the $CW_{avg}$ as determined in blocks 117, 119 and 121.

The CLEAN WATER value is then used to determine turbidity. In particular, turbidity is defined as $$\text{Turbidity}=(\text{CURRENT TURBIDITY MEASUREMENT})/\text{CLEAN WATER} \quad (9).$$

The turbidity is then normalized by multiplying the above ratio by 100. Clean water will typically have a turbidity value of 100, while very turbid water will have a value ranging from 5 to 20.

Referring again to FIG. 12, the circulation operation follows the fill operation. The circulation operation is shown in greater detail in FIG. 15. The circulation operation for each Fill Cycle depends upon whether it is a Pre-Wash Fill Cycle, a Main Wash Fill Cycle, a Rinse Fill Cycle, or a Final Rinse Fill Cycle. The routine in FIG. 15 determines which Fill Cycle is being implemented and branches the appropriate one of the circulate routines, PRE-WASH, MAIN WASH, RINSE, and FINAL RINSE. Each of these routines controls certain aspects of the corresponding Fill Cycle. The PRE-WASH routine is called during one or more circulation operations that occur before the Main Wash Fill Cycle. The MAIN WASH is the Main Wash Fill Cycle and includes the dispensing of the detergent. Following the Main Wash Fill Cycle there could be several Rinse Fill Cycles, which function to remove the detergent and the suspended particulates. The Final Rinse Fill Cycle includes the final circulation operation of the wash operating cycle which dispenses a rinsing agent. During the circulation phase, if the fill number count is less than the number representing the Main Wash Fill Cycle at 88, then the PRE-WASH operation is enabled at 90. A greater description of the PRE-WASH operation is provided below. Alternatively, if the fill number count is equal to or greater than the Main Wash Fill number, then the fill number count is examined at 92 to determine if it equals the Main Wash Fill number. If the fill number is equal to the Main Wash Fill number, then the MAIN WASH is performed at 94. A greater description of the MAIN WASH operation is provided below. If the fill number does not equal the Main Wash Fill number, then fill number is examined at 96 to determine if it is less than the maximum fill number. If the fill number is less than the maximum fill number, then RINSE is performed at 98. A greater description of the RINSE operation is provided below. Alternatively, if the fill number is not less than the maximum fill number, then the FINAL. RINSE is performed at 100. A greater description of the FINAL RINSE operation is provided below.

Figure 16:
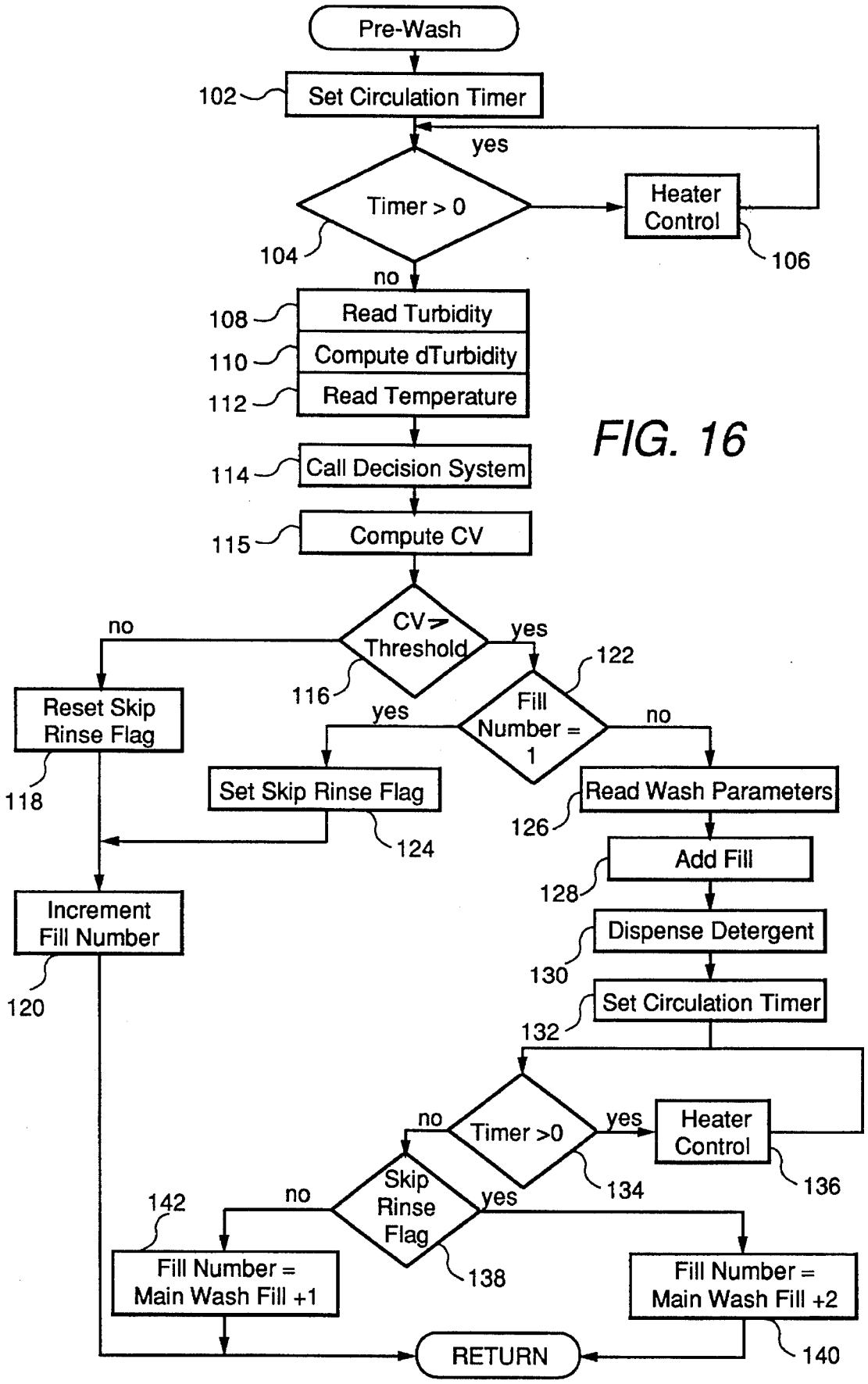
FIG. 16 is a flow chart of a PRE-WASH routine.
Figure 17:
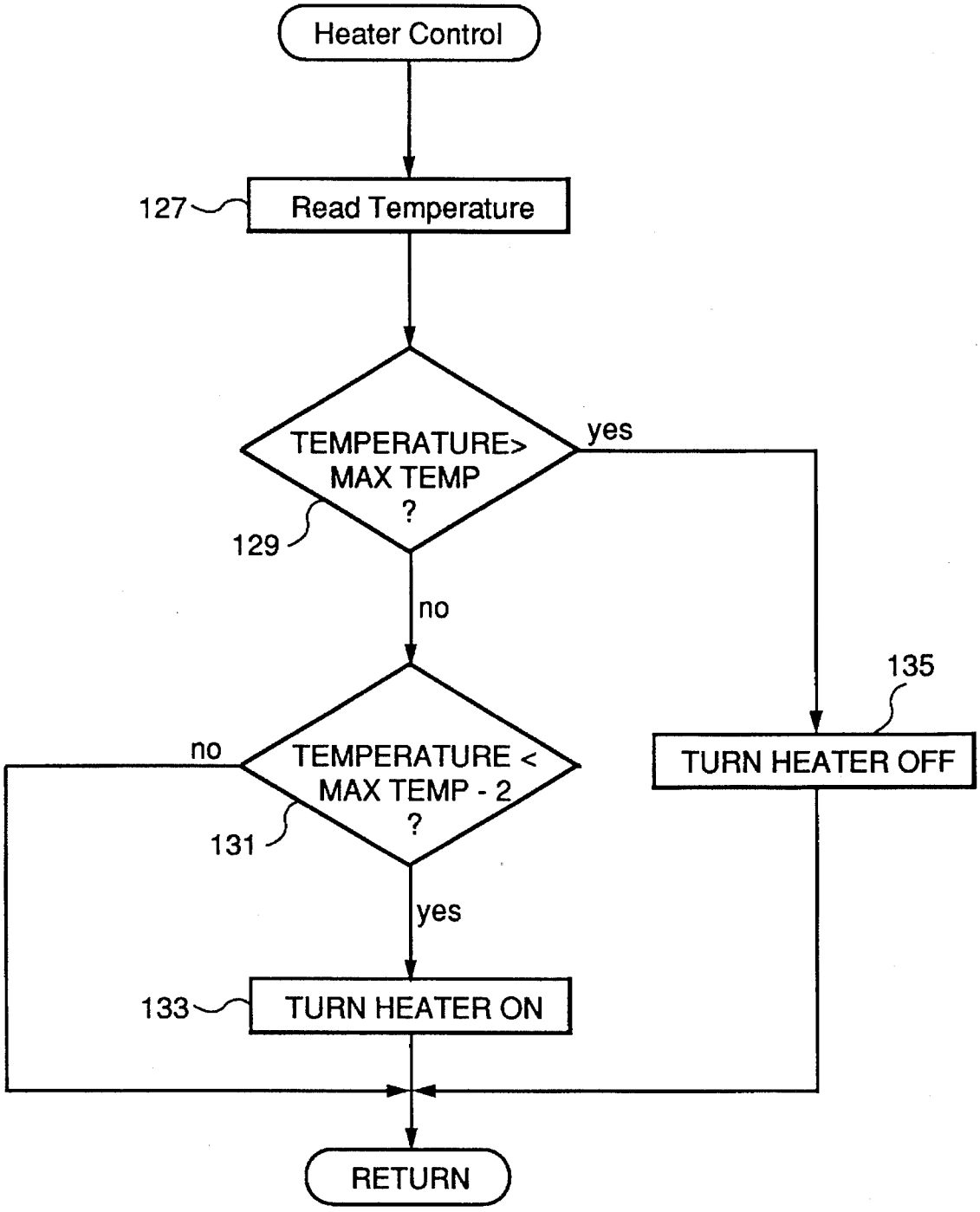
FIG. 17 is a flow chart describing a heater control routine.
Figure 18:
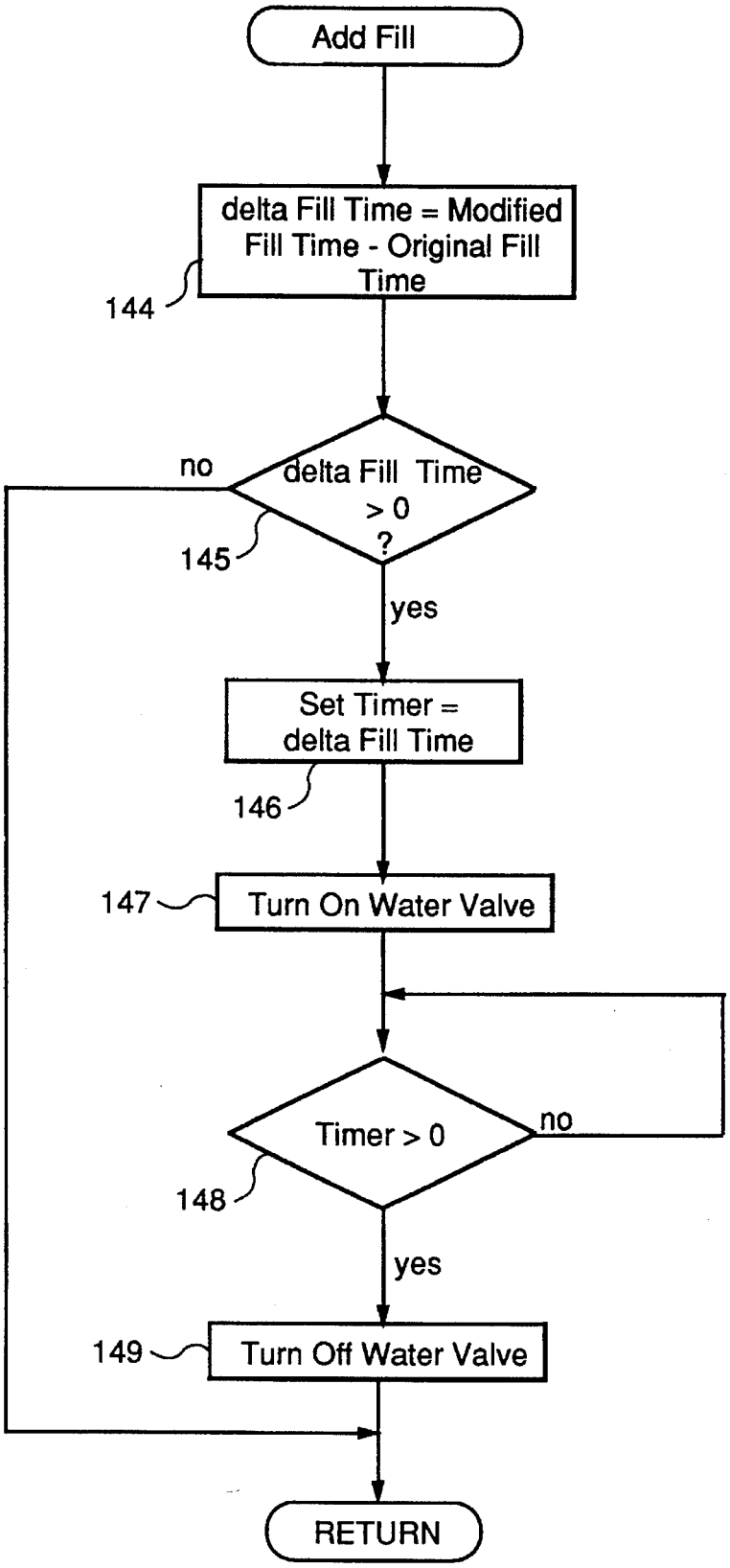
FIG. 18 is a flow chart of an ADD FILL routine.

FIG. 16 is a detailed flow chart of the PRE-WASH routine. This routine is more complex than the MAIN WASH, RINSE, and FINAL RINSE routines because this routine adjusts the operating cycle to adapt to the soil level.

In this routine the decision system 46 determines when to implement the Main Wash Fill Cycle and/or following the Main Wash Fill Cycle to skip a Rinse Fill Cycle. In this routine, the combination of the state or status of the circulation timer, the decision system, and the water temperature, dictate the duration and the number of Pre-Wash Fill Cycles. At the beginning of the PRE-WASH routine, a circulation timer is set at 102 so that the water circulates for a predefined amount of time determined from the wash parameter look-up tables of FIGS. 5A–5B. The circulation timer starts after completing the FILL routine. Typically, the circulation timer runs from about 2 minutes to about 31 minutes.

As long as the circulation timer is still on at 104, the controller regulates the water temperature during the circulation phase at 106. A flow chart describing the heater control regulation is set forth in FIG. 17. In particular, the actual temperature of the water is measured by the temperature sensor 28 at 125 and is compared to a maximum temperature setpoint at 127. If the actual temperature is less than the maximum-temperature setpoint at 127, then the actual temperature is compared to the maximum temperature setpoint minus two degrees at 129. If the actual temperature is less than the maximum temperature setpoint time minus two degrees, then the heater element 38 is turned on at 131. However, if the actual temperature is greater than the maximum temperature setpoint minus two degrees, then the heater control subroutine is complete. If the actual temperature is greater than the maximum temperature setpoint at 127, then the heater element 38 is turned off at 133 and the heater control subroutine is complete.

Referring again to FIG. 16, after the circulation time period has elapsed, the controller reads the turbidity sensor at 108 and normalizes the values in the manner as described earlier. After normalizing the turbidity values, the controller 30 computes the derivative of turbidity at 110. The turbidity derivative (dTurbidity) is computed by the microprocessor and is defined as:

$$\text{dTurbidity}=\text{Previous Turbidity}-\text{Current Turbidity} \quad (10).$$

The dTurbidity value will be zero in the first circulation fill, since there is no previous value for comparison. In addition to reading the turbidity values and computing the dTurbidity, the controller 30 reads the temperature sensor at 112.

After the turbidity sensor has been read, the derivative of turbidity has been computed, and the temperature sensor has been read, the decision system is called at 114. The decision system then accepts these three values as inputs. The decision system uses the inputs to decide whether or not to skip a Rinse Fill Cycle or whether or not to skip a Pre-Wash Fill Cycle and implement the Main Wash Fill Cycle. As mentioned above, the decision system uses fuzzy logic to compute an output value, CV, at 115 for the given input values. Then the computed CV value is compared to a predetermined threshold value at 116. In the illustrative embodiment, the predetermined threshold value is 50. If the CV value is not greater than the predetermined threshold value, signifying that the sensed conditions do not warrant altering the operating cycle, then the decision system resets a skip rinse flag at 118, increments the machine fill counter at 120, completes the PRE-WASH routine (i.e., completing the CIRCULATION routine of FIG. 15), and starts a DRAIN operation as set forth in FIG. 12. On the other hand, if the CV value is greater than or equal to the predetermined threshold, signifying that the sensed conditions may merit a change in the operating cycle, then the decision system determines whether the Main Wash Fill Cycle should be enabled at 122 or to continue with the Pre-Wash Fill Cycle. In particular, if the fill number does equal one at 122, then the Main Wash Fill Cycle is not enabled and the Pre-Wash Fill Cycle is continued. If the Pre-Wash Fill Cycle is continued, then the skip rinse flag is set at 124 to set the stage for skipping a Rinse Fill Cycle, the fill number is incremented at 120, the PRE-WASH routine is completed (i.e., completing the CIRCULATION routine of FIG. 15), and starts the DRAIN routine as set forth in FIG. 12. Decision block 122 prevents the controller 30 from converting the first Pre-Wash Fill Cycle to a Main Wash Cycle.

However, ff the fill number does not equal one at 122, then the Pre-Wash Fill Cycle transitions to the Main Wash Fill Cycle by the sequence of operations represented by blocks 126–142. In particular, the decision system reads the wash parameters for the Main Wash Fill Cycle at 126. The wash parameters are found in the tables of FIGS. 5A–5B in the Main Wash Modifiers section. In this step, the additional fill time is determined, the circulation time is adjusted, and the maximum temperature and the extend time is changed to the value in the main wash modifiers section. These steps and the applicable values depend on whether a Pre-Wash Fill Cycle or a Rinse Fill Cycle are to be skipped. For example, if the dishwasher 10 is operating in the Normal operating cycle and the controller 30 decides to skip a Pre-Wash Fill Cycle, then during the second Pre-Wash Fill Cycle (i.e., fill number 2 or PRE WASH 2) the Main Wash Fill Cycle will be enabled, changing the washing parameters. Thus, the fill time for the second Pre-Wash Fill Cycle, (i.e., 80 seconds), the circulation time (i.e., five minutes), the maximum temperature (i.e., 120°), and the extend time (i.e., zero) increase to the Main Wash Modifier parameters so that the fill time changes to 90 seconds, the circulation time changes to 15 minutes, the maximum temperature changes to 130°, and the extend time changes to 15 minutes. The change in fill time (i.e., delta FILL TIME), which is 10 seconds, is used later in the ADD FILL routine and the change in the circulation time (i.e., delta CIRCULATION TIME), which is 10 minutes is used in step 132, and the modified maximum temperature and extend time are used in the MAIN WASH routine. Also, if the controller 30 decides to skip a Pre-Wash Fill Cycle and a Rinse Fill Cycle, then after the first Pre-Wash Fill. Cycle (i.e., fill number 1 or PRE WASH 1) the Main Wash Fill Cycle will be implemented, changing the washing parameters. Thus, the fill time for PRE WASH 1 (i.e., 80 seconds), the circulation time (i.e., five minutes), the maximum temperature (i.e., 120°), and the extend time (i.e., zero) are increased to the Main Wash Modifier parameters so that the fill time changes to 90 seconds, the circulation time changes to 12 minutes, the maximum temperature changes to 125°, and the extend time changes to 15 minutes.

When transitioning from a Pre-Wash Fill Cycle to a Main Wash Fill Cycle, after reading the read wash parameters at 126, an add fill operation is performed at 128. The ADD FILL routine is described in more detail in FIG. 18. The primary function of the ADD FILL routine is to add additional clean water. In the ADD FILL routine described in FIG. 18, the delta FILL TIME is determined at 144. The delta FILL TIME is equal to the modified fill time minus the original fill time. As mentioned above, both the modified fill time and the original fill time are obtained from the tables in FIGS. 5A–5B. Next, the delta FILL TIME is examined at 145, to determine if it is greater than zero. If the delta FILL TIME is less than zero, then no additional water is added and the ADD FILL routine is completed. However, if the delta FILL TIME is greater than zero, then the ADD FILL timer is set at 146 and the water valve 21 is turned on at 147. Once the ADD FILL timer has expired at 148, then the water valve 21 is turned off at 149 and the ADD FILL routine is completed.

Referring again to FIG. 16, upon completion of the ADD FILL routine, the decision system dispenses detergent at 130. The detergent may be dispensed before, during, or after the ADD FILL routine. After dispensing detergent, the circulation timer is adjusted at 132 in the manner described earlier, so that the duration is varied between the minimum and maximum values as a function of water temperature. The controller regulates the temperature of the water and the circulation continues for the duration of the specified time. As long as the circulation timer is still on at 134, the controller regulates the water temperature at 136 in the manner set forth in the flow chart of FIG. 17. After the circulation timer has been shut off, the skip rinse flag is examined at 138. If the skip rinse flag has been set, then the fill number is incremented at 140 so that it equals the main wash fill count plus two to adjust the count for the skipping of one Pre-Wash Fill Cycle and one Rinse Fill Cycle and the PRE-WASH routine is completed. However, if the skip rinse flag has not been set, then the cycle number is incremented at 142 so that it equals the main wash fill number plus one to adjust the count for the skipping of one Pre-Wash Fill Cycle and the PRE-WASH routine is completed (i.e., completing the CIRCULATION routine of FIG. 15), and starts the DRAIN routine as set forth in FIG. 12.

Figure 19:
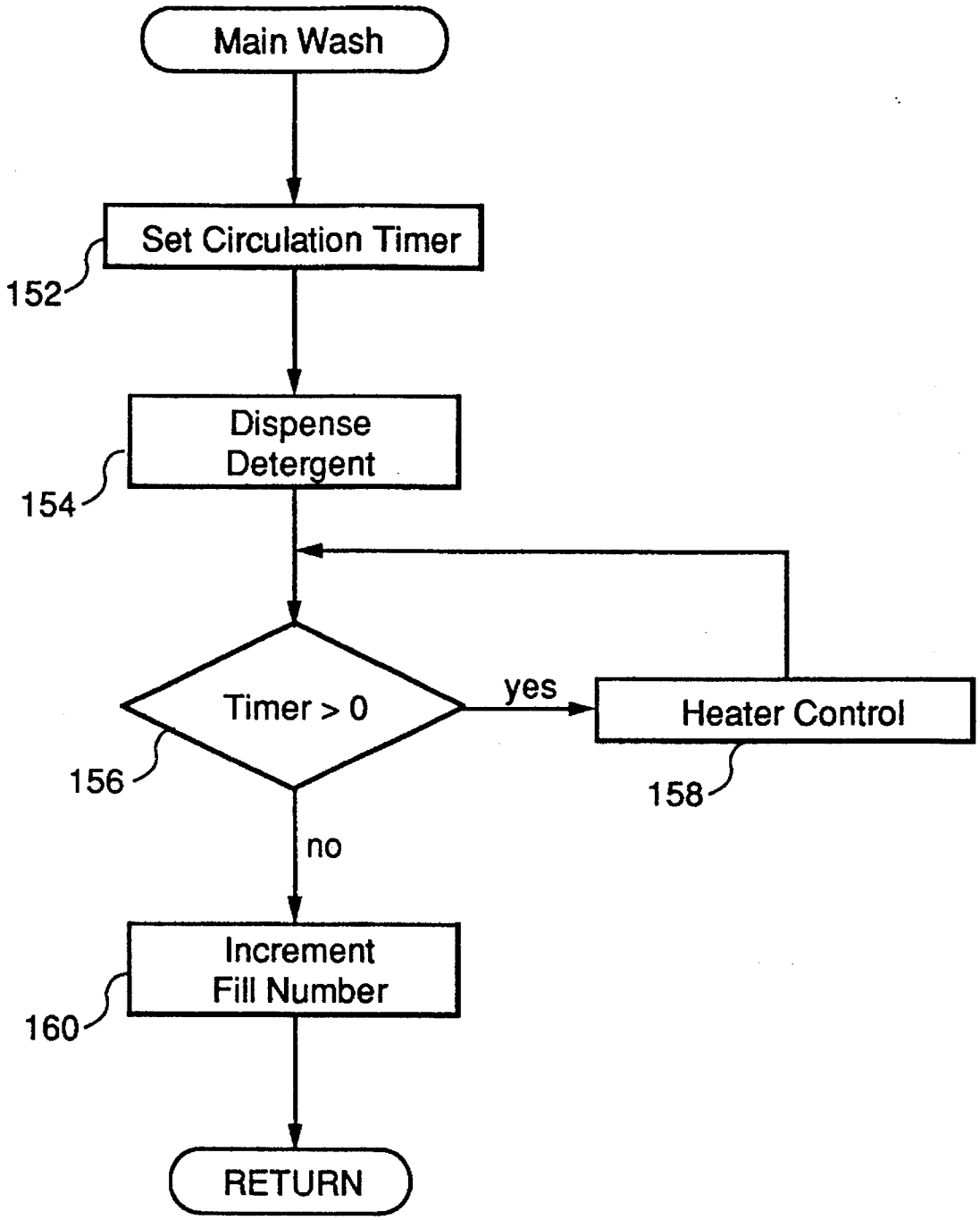
FIG. 19 is a flow chart of a MAIN WASH routine.
Figure 20:
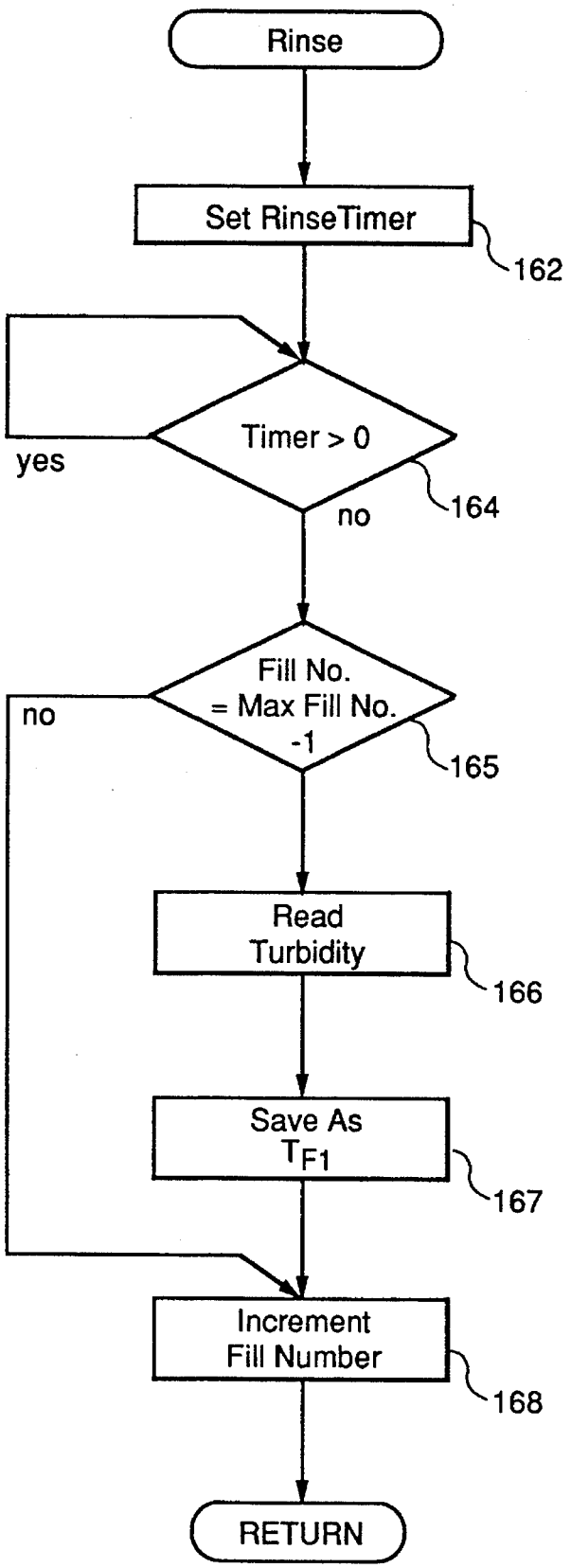
FIG. 20 is a flow chart of a POST RINSE routine.

The controller only allows a predefined number of Pre-Wash Fill Cycles according to the tables set forth in FIGS. 5A–5B. For example, in the Normal Wash operating cycle, the maximum predefined number of Pre-Wash Fill Cycles is two with the Main Wash Fill Cycle having a fill number of three. Referring again to FIG. 15, if the predefined number of Pre-Wash Fill Cycles has occurred, then the fill number count will be greater than or equal to the Main Wash Fill number at 88. Then the fill number count is examined at 92 to determine if it equals the Main Wash Fill number. If the fill number is equal to the Main Wash Fill number (i.e., 3), then the MAIN WASH routine is performed at 94 to implement the Main Wash Fill Cycle. As depicted in FIG. 19, the sequence of steps the controller executes for the MAIN WASH routine is as follows. First the circulation timer is set at 152 in the manner described earlier on page 14, so that the duration is varied between the minimum and maximum values as a function of water temperature. Then the detergent is dispensed at 154. The circulation continues until circulation time has elapsed at 156. During the circulation, the controller regulates the water temperature at 158 in the manner set forth in the flow chart of FIG. 17. Upon completion of the MAIN WASH routine, the controller increments the fill number count at 160.

Referring again to FIG. 15, if the fill number does not equal the Main Wash Fill number, then fill number is examined at 96 to determine if it is less than the maximum fill number. If the fill number is less than the maximum fill number, then the RINSE routine is performed at 98. The controller 30 sequences through one or more Rinse Fill Cycles as described in FIG. 20. The RINSE routine is similar to the MAIN WASH routine, except the controller 30 does not dispense detergent and does not utilize the heater to control water temperature. In particular, the rinse timer is set at 162 and the RINSE routine continues until the rinse timer has elapsed at 164. In addition to controlling duration of the rinse operation, a turbidity measurement is made at the end of the last rinse operation prior to the Final Rinse Fill Cycle which is used together with the previous measured HEALTH Value and a turbidity measurement made at the end of the Final Rinse operation hereinafter described with reference to FIG. 21, to update the rolling Clean $\text{Water}_{avg}$, as hereinafter described.

The last rinse operation prior to the Final Rinse Fill Cycle is identified by the Fill Number which equals the Maximum Fill Number minus one. When the Fill Number equals Maximum Fill Number minus one, as determined at Block 165, a turbidity measurement is made at 166 and saved as the variable $T_{F1}$ at 167. Upon completion of the RINSE routine, the controller increments the fill number count at 168.

Figure 21:
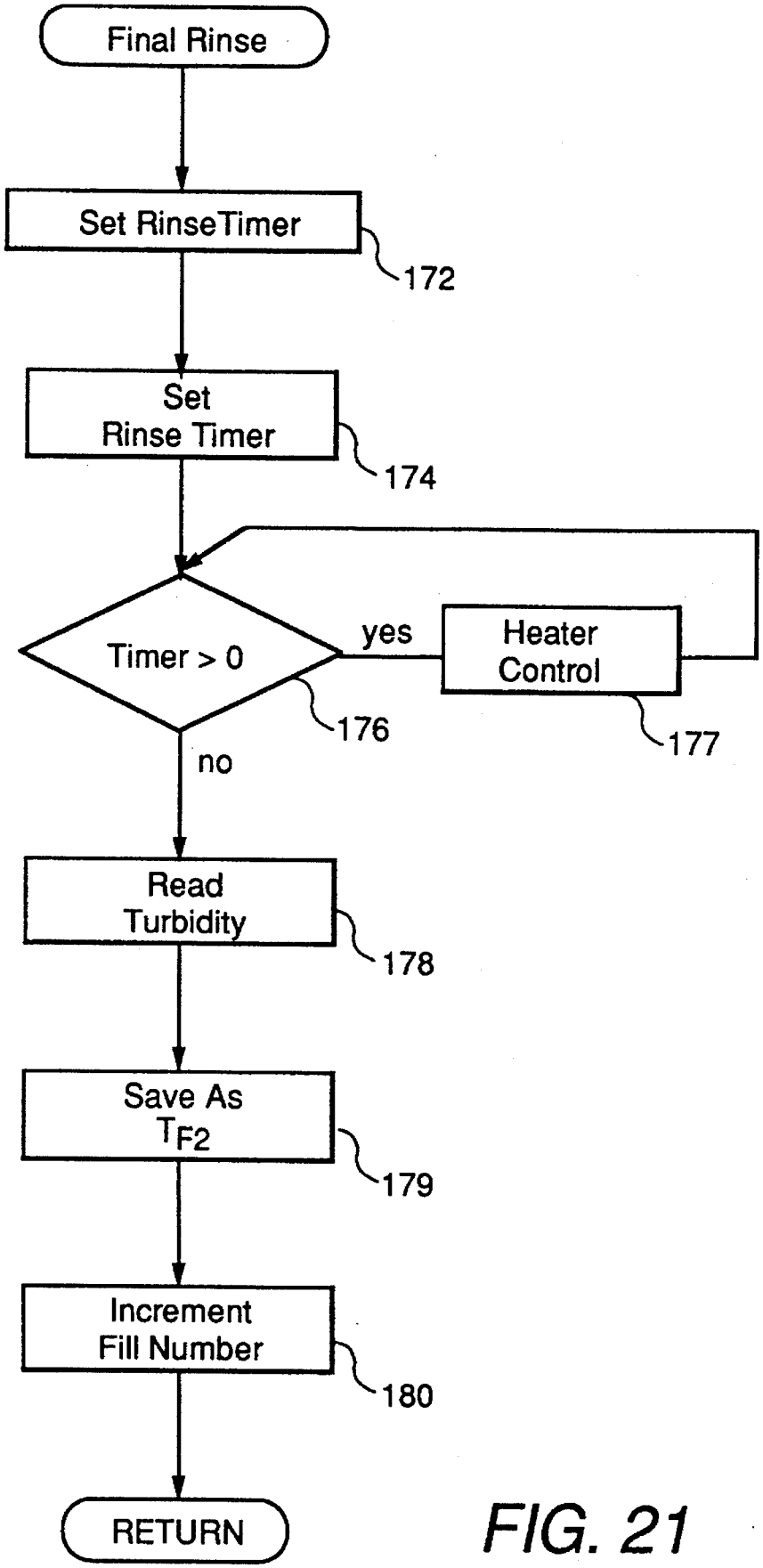
FIG. 21 is a flow chart of a FINAL RINSE routine.
Figure 22:
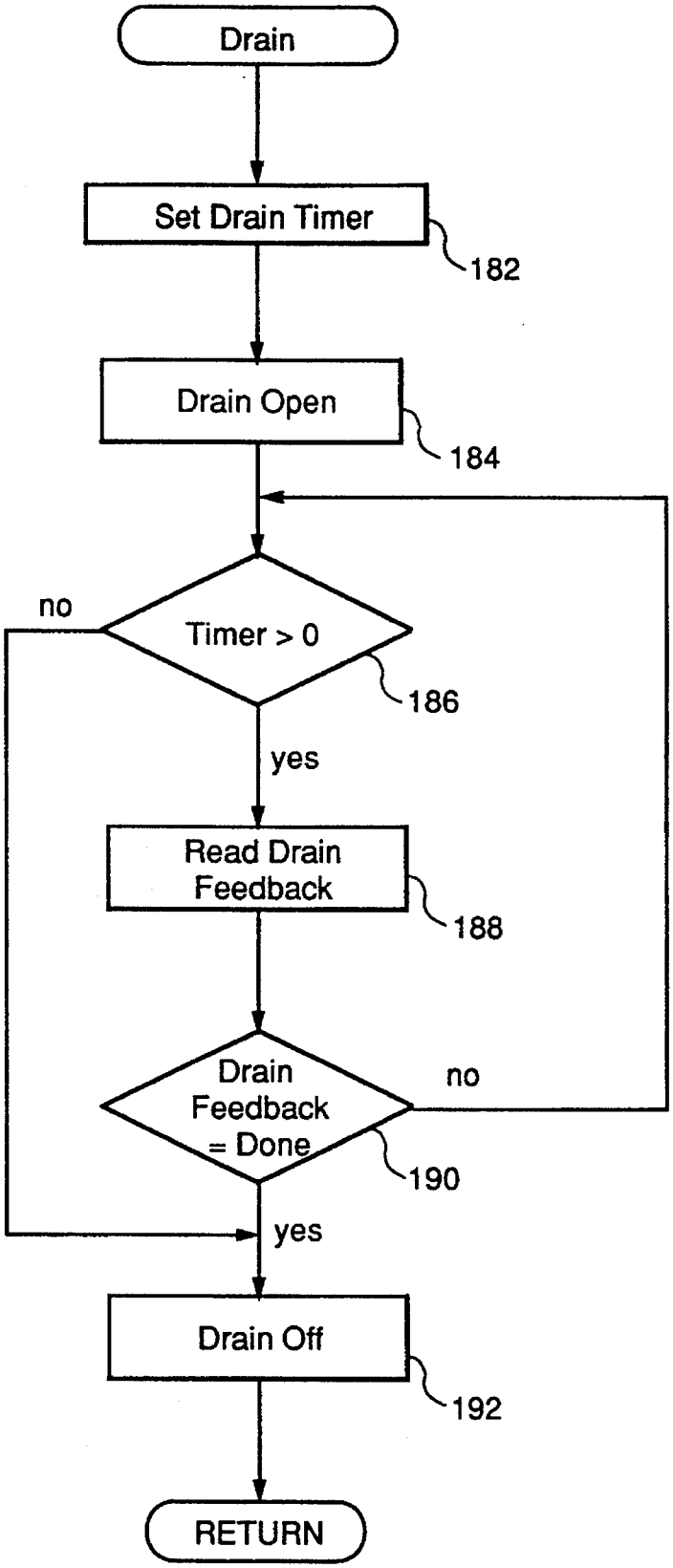
FIG. 22 is a flow chart of a DRAIN routine.

Referring again to FIG. 15, if the fill number at 96 is greater than or equal to the maximum fill number, then the controller 30 sequences th-rough the FINAL RINSE routine as described in the flow chart of FIG. 21. The sequence of steps in the FINAL RINSE routine is identical to the MAIN WASH routine, except that the controller 30 dispenses rinse agent rather than detergent. In particular, the rinse timer is set at 172 and rinsing agent is dispensed at 174. The FINAL RINSE routine continues until the rinse timer has elapsed at 176. During the circulation portion of the FINAL RINSE routine, the controller 30 regulates the water temperature at 177 in accordance with the manner set forth in the flow chart of FIG. 17. When the rinse timer times out, the final turbidity measurement is made at 178 and saved in memory as the variable $T_{F2}$. This value is used to update the CLEAN $\text{WATER}_{avg}$ value as hereinafter described with reference to the SHUT DOWN System step in FIG. 12. Upon completion of the FINAL RINSE operation, the controller 30 increments the fill number count at 180.

A drain operation follows each circulation operation within a machine cycle. The drain operation may be either a complete pump out or a partial pump out depending on what was specified in the wash parameters. The DRAIN routine implemented In the illustrative embodiment is described In detail in FIG. 22. In particular, the drain timer is set at 182 so that the pump 20 is able to completely evacuate the sump 22. After the drain timer is set, the drain solenold Is energized and then the drain Is opened at 184. The DRAIN routine continues until the drain timer has elapsed at 186. As long as the drain timer is on, the drain feedback device is read at 188 to monitor how much water is being drained. If the drain feedback device equals a predetermined quantity at 190 then the drain is shut off at 192. Alternatively, if the drain feedback device does not equal the predetermined quantity, then the drain timer is examined again at 186. If the drain timer has not expired, then steps 188 and 190 are repeated. However, if the drain timer has elapsed, then the drain is shut off at 192. After the drain has been shut off for the Final Rinse Fill Cycle marking completion of the wet portion of the operating cycle, the rolling average CLEAN $\text{WATER}_{avg}$ is updated at 74 of FIG. 12 by comparing the three clean water turbidity measurements made during the just completed operating cycle, HEALTH, $T_{F1}$ and $T_{F2}$. The largest of these values is then used as the variable CLEAN $\text{WATER}_{new}$ in the equation below to compute the CLEAN $\text{WATER}_{avg}$ value for the next operating cycle.

$$\text{CLEAN WATER}_{avg}=(\text{CLEAN WATER}_{avg}\text{X7}+\text{CLEAN WATER}_{new})/8.$$

The dry portion of the operating cycle is then implemented in a conventional manner as either a passive air dry or a heated drying operation and the system is shut down.

It is therefore apparent that there has been provided in accordance with the present invention, a system and method for adjusting an operating cycle of an appliance that fully satisfy the aims, advantages and objectives hereinbefore set forth. The invention has been described with reference to an illustrative embodiment, however, it will be appreciated that variations and modifications can be effected by a person of ordinary skill in the art without departing from the scope of the invention.

We claim:

1. An appliance for cleansing soiled articles, comprising:

a container for receiving the soiled articles;

a circulation pump for distributing a liquid to the container;

a temperature sensor for sensing temperature of the liquid being distributed and providing a signal representation thereof;

a turbidity sensor for sensing of turbidity the liquid being distributed and providing a signal representation thereof; and a controller, responsive to both the temperature and turbidity sensors, for adjusting an operating cycle of the appliance as a function of the liquid temperature and the liquid turbidity.

2. An appliance according to claim 1, wherein said controller includes a decision system comprising a fuzzy rule base fired as input values from the liquid temperature and liquid turbidity sensors are received, said decision system matching the rules in said fuzzy rule base to said input values, and outputting a confidence value, said controller being operative to adjust the operating cycle as a function of said confidence value.

3. An appliance according to claim 2, wherein the operating cycle is further adjusted as a function of the rate of change of liquid turbidity.

4. An appliance according to claim 3, wherein the input values are representative of temperature, turbidity, and derivative of turbidity.

5. An appliance according to claim 3, wherein an operating cycle comprises at least one pre-wash fill cycle, a main wash fill cycle, a rinse fill cycle, and a final rinse fill cycle.

6. An appliance according to claim 5, wherein the decision system determines whether a pre-wash fill cycle should be skipped.

7. An appliance according to claim 5, wherein the decision system determines whether a rinse fill cycle should be skipped.

8. An appliance according to claim 5, wherein said controller varies the duration of at least one of the fill cycles as a function of liquid temperature.

9. An appliance according to claim 1, wherein the operating cycle is further adjusted as a function of the rate of change of liquid turbidity.

10. An appliance according to claim 9, wherein an operating cycle comprises at least one pre-wash fill cycle, a main wash fill cycle, a rinse fill cycle, and a final rinse fill cycle.

11. An appliance according to claim 10, wherein the controller determines whether a pre-wash fill cycle should be skipped.

12. An appliance according to claim 11, wherein the controller determines whether a rinse fill cycle should be skipped.

13. An appliance according to claim 10, wherein the controller determines whether a rinse fill cycle should be skipped.

14. An appliance according to claim 10, wherein said controller varies the duration of at least one of the fill cycles as a function of liquid temperature.

15. An appliance according to claim 9, wherein an operating cycle comprises a plurality of fill cycles and wherein the controller is operative to adjust the operating cycle as a function of the liquid temperature, the liquid turbidity and the rate of change of liquid turbidity by skipping one or more of the fill cycles.

16. An appliance according to claim 15, wherein said controller is operative to receive a reference input from said turbidity sensor during the fill operation for the initial one of said fill cycles and to use the reference input to establish a clean water reference value.

17. An appliance according to claim 16, wherein said controller decides whether to skip one or more subsequent fill cycles as a function of the ratio of a value derived from said first input and said clean water reference value.

18. An appliance according to claim 1, wherein an operating cycle comprises a plurality of fill cycles and wherein the controller is operative to adjust the operating cycle as a function of the liquid temperature and the liquid turbidity by skipping one or more of the fill cycles.

19. An appliance according to claim 18, wherein each of said fill cycles includes a fill operation, a circulate operation and a drain operation, and wherein the controller is operative to receive a first input from said turbidity sensor at the end of the circulate operation during at least one of said fill cycles, and wherein said controller decides whether to skip one or more subsequent fill cycles as a function of said first input.

20. An appliance for cleansing soiled articles, comprising:

a container for receiving the soiled articles and liquid for washing the articles;

a mechanism for distributing the liquid to the container for effecting washing of the articles;

a temperature sensor for sensing temperature of the liquid being distributed and providing a signal representation thereof;

a turbidity sensor for sensing turbidity of the liquid being distributed and providing a signal representation thereof; and a controller, responsive to both the temperature and turbidity sensors, for adjusting an operating cycle of the appliance as a function of the liquid temperature, the liquid turbidity, and the rate of change of liquid turbidity, whereby the operating cycle is adjusted as a function of the liquid temperature, the soil level of the articles, and the soil removal rate from the articles.

21. An appliance according to claim 20, wherein said controller includes a decision system comprising a fuzzy rule base fired as input values from the liquid temperature and liquid turbidity sensors are received, said decision system matching the rules in said fuzzy rule base to said input values, and outputting a confidence value, said controller being operative to adjust the operating cycle as a function of said confidence value.

22. An appliance according to claim 21, wherein the input values are representative of temperature, turbidity, and derivative turbidity.

23. A dishwasher, comprising:

a container for accommodating a plurality of articles;

a circulation pump for distributing a liquid to the container;

a temperature sensor for sensing temperature of the liquid being distributed and providing a signal representation thereof;

a turbidity sensor for sensing turbidity of the liquid being distributed and providing a signal representation thereof; and a controller, responsive to both the temperature and turbidity sensors, for adjusting an operating cycle of the dishwasher according to the liquid temperature, the liquid turbidity, and the rate of change of liquid turbidity, whereby the operating cycle is adjusted as a function of the liquid temperature, the soil level of the articles, and the soil removal rate from the articles.

24. A dishwasher according to claim 23 wherein, said controller includes a decision system comprising a fuzzy rule base fired as input values from the liquid temperature and liquid turbidity sensors are received, said decision system matching the rules in said fuzzy rule base to said input values, and outputting a confidence value, said controller being operative to adjust the operating cycle as a function of said confidence value.

25. A method for cleansing soiled articles, comprising the steps of:

providing a container for receiving the soiled articles;

distributing a liquid to the container;

sensing temperature and turbidity of the liquid being distributed; and adjusting a washing cycle according to both the liquid temperature and the liquid turbidity with a decision system comprising a fuzzy rule base fired as input values from the liquid temperature and liquid turbidity sensors are received, said decision system matching the rules in said fuzzy rule base to said input values, and outputting a confidence value, said controller being operative to adjust the operating cycle as a function of said confidence value.

26. A method according to claim 25, wherein the input values are representative of temperature, turbidity, and derivative of turbidity.

27. A method according to claim 25, wherein an operating cycle comprises at least one pre-wash fill cycle, a main wash fill cycle, a rinse fill cycle, and a final rinse fill cycle.

28. A method according to claim 27, wherein the decision system determines whether a pre-wash fill cycle should be skipped.

29. A method according to claim 27, wherein the decision system determines whether a rinse fill cycle should be skipped.

30. A method according to claim 27, further comprising varying the duration of at least one of the fill cycles as a function of liquid temperature.

* * * * *